US011560725B2

(12) United States Patent
Mullaney et al.

(10) Patent No.: US 11,560,725 B2
(45) Date of Patent: Jan. 24, 2023

(54) FORMWORK BRACE

(71) Applicant: InQuik IP Holdings Pty Ltd, Penrith (AU)

(72) Inventors: Nicholas Bruce Mullaney, Marulan (AU); Logan Peter Mullaney, Robertson (AU)

(73) Assignee: InQuik IP Holdings Pty Ltd, Penrith (AU)

( * ) Notice: Subject to any disclaimer, the term of this patent is extended or adjusted under 35 U.S.C. 154(b) by 0 days.

(21) Appl. No.: 16/965,049

(22) PCT Filed: Jan. 29, 2019

(86) PCT No.: PCT/AU2019/050063
§ 371 (c)(1),
(2) Date: Jul. 27, 2020

(87) PCT Pub. No.: WO2019/144201
PCT Pub. Date: Aug. 1, 2019

(65) Prior Publication Data

US 2020/0407986 A1 Dec. 31, 2020

(30) Foreign Application Priority Data

Jan. 29, 2018 (AU) ..... 2018200667

(51) Int. Cl.
*E04G 11/46* (2006.01)
*E04C 5/16* (2006.01)
(Continued)

(52) U.S. Cl.
CPC ..... *E04G 11/46* (2013.01); *E04G 11/36* (2013.01); *E04G 17/0755* (2013.01); *E04G 17/14* (2013.01)

(58) Field of Classification Search
CPC . E04G 13/04; E04G 11/46; E04B 5/19; E04B 5/38; E04B 5/40
See application file for complete search history.

(56) References Cited

U.S. PATENT DOCUMENTS 1,216,644 A * 2/1917 Ambursen ..... E04G 11/46 249/31
1,278,087 A * 9/1918 Ambursen ..... E04G 11/46 249/29
(Continued)

FOREIGN PATENT DOCUMENTS

CN 109518950 A * 3/2019 ..... E04G 13/04
DE 736045 C * 6/1943 ..... E04G 13/04
(Continued)

OTHER PUBLICATIONS

Translation for CN 109518950 A. (Year: 2019).*
(Continued)

*Primary Examiner* — Michael Safavi
(74) *Attorney, Agent, or Firm* — Michael Best & Friedrich LLP

(57) ABSTRACT

In summary the invention described herein is broadly directed to a module for forming a reinforced concrete structure comprising (a) a formwork member that defines a cavity, (b) a reinforcement structure in the cavity, and (c) at least one formwork brace interconnecting the formwork member and the reinforcement structure.

20 Claims, 17 Drawing Sheets

(51) Int. Cl.

| | |
|---|---|
| ***E04G 11/36*** | (2006.01) |
| ***E04G 17/075*** | (2006.01) |
| ***E04G 17/14*** | (2006.01) |

(56) References Cited

U.S. PATENT DOCUMENTS

| | | | | | |
|---|---|---|---|---|---|
| 1,278,286 | A * | 9/1918 | Ambursen | E04G 11/46 | 249/30 |
| 1,292,986 | A * | 2/1919 | Ambursen | E04G 11/46 | 249/30 |
| 1,331,491 | A * | 2/1920 | Ferguson | E04G 13/04 | 269/203 |
| 1,699,503 | A * | 1/1929 | Lampert | E04G 13/04 | 269/111 |
| 1,726,976 | A * | 9/1929 | Bosco | E04G 13/04 | 269/141 |
| 1,887,385 | A * | 11/1932 | Wertz | E04G 11/46 | 249/23 |
| 1,999,783 | A | 4/1935 | Riesbol | | |
| 4,210,304 | A | 7/1980 | Mannina | | |
| 5,653,077 | A * | 8/1997 | Carnicello | E04B 5/14 | 52/338 |
| 6,634,151 | B1 * | 10/2003 | Roth | E04B 5/40 | 248/343 |
| 7,571,580 | B2 * | 8/2009 | Miller | E04C 5/0645 | 52/650.3 |
| 8,800,229 | B2 * | 8/2014 | Rahimzadeh | E04B 5/40 | 52/349 |
| 2010/0006722 | A1 | 1/2010 | Brouillard | | |
| 2016/0340891 | A1 | 11/2016 | Rice | | |
| 2019/0376283 | A1 * | 12/2019 | Hirayama | E04C 3/293 | |

FOREIGN PATENT DOCUMENTS

| | | | | | |
|---|---|---|---|---|---|
| EP | 1936038 | A1 * | 6/2008 | E04G 13/00 | |
| FR | 902956 | A * | 9/1945 | E04B 5/40 | |
| FR | 2086613 | A5 * | 12/1971 | E04F 19/08 | |
| GB | 574458 | | 1/1946 | | |
| JP | 2017096061 | A | 6/2017 | | |
| KR | 101666980 | B1 * | 10/2016 | | |
| KR | 101706086 | B1 * | 2/2017 | E04B 5/40 | |
| KR | 20180112311 | A * | 10/2018 | E04B 5/40 | |
| KR | 101950872 | B1 * | 5/2019 | E04G 13/04 | |
| WO | WO-2016161478 | A1 * | 10/2016 | E04B 9/00 | |
| WO | WO-2017039212 | A1 * | 3/2017 | E04G 11/36 | |
| WO | WO-2020138994 | A1 * | 7/2020 | E04G 13/04 | |

OTHER PUBLICATIONS

Translation for KR 101666980 B1. (Year: 2016).*

International Search Report for Application No. PCT/AU2019/050063 dated May 8, 2019 (7 pages).

International Preliminary Report on Patentability for Application No. PCT/AU2019/050063 dated Jan. 31, 2020 (25 pages).

Japanese Patent Office Notice of Reasons for Refusal for Related Application No. 2020562798 dated Nov. 1, 2022 (10 pages, including an English translation).

* cited by examiner 2
7a
8
7
7
7a
6
8

8
2

7
α
8
6
2

2

2
8
8

FORMWORK BRACE

TECHNICAL FIELD

This invention relates to a module for forming a reinforced concrete structure and to a brace for constructing a formwork member of the module. Additionally, there is disclosed a method of constructing the formwork member of the module and a method of constructing a pre-tensioned formwork member.

BACKGROUND

When manufacturing construction modules, there is typically a large safety margin factored into each component, to safely support the structure. As a consequence, some of the additional material factored into the design becomes redundant after concrete or an alternative substrate is introduced into the formwork. Once the concrete is introduced and set, the additional material and accompanying weight penalty is maintained in the structure for life.

A limitation on the size of formwork panels further imposes weight and handling penalties on construction projects, in part due to the limitations on manufacturing of the constituent components, for example the grade, gauge, surface coatings and dimensions of steel products available.

The present invention was conceived with these shortcomings in mind.

SUMMARY OF THE INVENTION

In broad terms, the invention provides a formwork brace for interconnecting a formwork member and an internal reinforcement structure, comprising: a body configured to partially extend around the formwork member; and a plurality of connectors configured to couple together the body, the formwork member, and the internal reinforcement structure, so that in use the body ties together the formwork member and the internal reinforcement structure.

The module may further comprise a plurality of formwork braces at spaced intervals along the length of the module.

The formwork member may comprise a plurality of sections along the length of the module.

At least one of the plurality of formwork braces may be located at an intersection between successive sections. The at least one formwork brace may be located at an intersection between successive sections thereby overlapping a portion of each of the successive sections in substantially equal amounts.

The module may further comprise a plurality of the formwork braces at spaced intervals along the length of each section.

The formwork brace may comprise a body that partially extends around the formwork member and a plurality of connectors that couple together the body, the formwork member, and the reinforcement structure.

The body may comprise a base and a pair of upwardly extending legs.

The pair of legs may be substantially parallel and extend outwardly from opposing ends of the base.

The body may be configured to be U-shaped.

At least one of the connectors may be configured to extend across the formwork such that both a first and a second end of the connector is engaged in tension across the body.

At least one of the connectors may be configured to extend across the formwork such that both a first and a second end of the connector are engaged in tension across the body.

At least one of the connectors may be configured to couple the body to the internal reinforcement structure.

At least one of the connectors may be configured to extend from the body inwardly across the formwork to directly engage the internal reinforcement structure.

The formwork brace may further comprise an anchor, wherein the anchor is interleaved with the internal reinforcement structure and coupled to the body from an exterior of the formwork member. The anchor may be adjustably coupled to the body to position the formwork member relative to the internal reinforcement structure.

In some embodiments the body may be located on an exterior of the formwork. In other embodiments, the body may be located on an interior of the formwork.

In a further aspect, the invention provides a formwork brace for interconnecting a formwork member and an internal reinforcement structure, comprising: a body configured to partially extend around the formwork member; and a plurality of connectors configured to couple together the body, the formwork member, and the internal reinforcement structure, so that in use the body ties together the formwork member and the internal reinforcement structure.

In a further aspect, the invention provides a method of constructing a formwork for a settable substrate, comprising the steps of: positioning a plurality of formwork sections end-to-end such that an end portion of a first section abuts an end portion of a second section; locating a formwork brace to cradle overlapping ends of the first and second sections; inserting a reinforcement structure into a cavity formed by each of the two formwork sections; and engaging at least one connector between the formwork brace and the reinforcement structure through the first and second formwork sections.

The method may further comprise the step of tightening the connector from an exterior of the plurality of formwork sections to thereby locate the formwork sections relative to the reinforcement structure.

The method may further comprise the step of tightening the connector from an exterior of the plurality of formwork sections such that a clamping force is applied to the formwork by the formwork brace urging the first and second formwork sections together.

The method may further comprise the step of introducing a fluid concrete mixture into the cavity of the formwork sections in which the reinforcement structure is located.

The step of introducing the fluid concrete into the cavity may load the formwork, particularly the base of the formwork, thereby pulling the abutting ends of the first and second sections towards one another.

In a still further aspect, the invention provides a method of constructing a pre-tensioned formwork, the method comprising the steps of: orienting a formwork brace as described herein about an exterior of a formwork section; locating an internal reinforcement structure within a cavity of the formwork section; and engaging at least one connector between the formwork brace and the internal reinforcement structure, wherein as the at least one connector is engaged with the internal reinforcement structure, a compressive force is applied around the exterior of the formwork section, urging the formwork section towards the internal reinforcement member.

The method may further comprise the steps of: engaging a supplementary connector between two portions of the formwork brace, so that the supplementary connector extends across the formwork section; and tensioning the supplementary connector to apply a clamping force across the formwork brace, so that the formwork member is compressed about the internal reinforcement structure and the formwork brace.

Various features, aspects, and advantages of the invention will become more apparent from the following description of embodiments of the invention, along with the accompanying drawings in which like numerals represent like components.

BRIEF DESCRIPTION OF THE DRAWINGS

Embodiments of the invention are illustrated by way of example, and not by way of limitation, with reference to the accompanying drawings, of which.

Figures 1A, 1B, 1C:
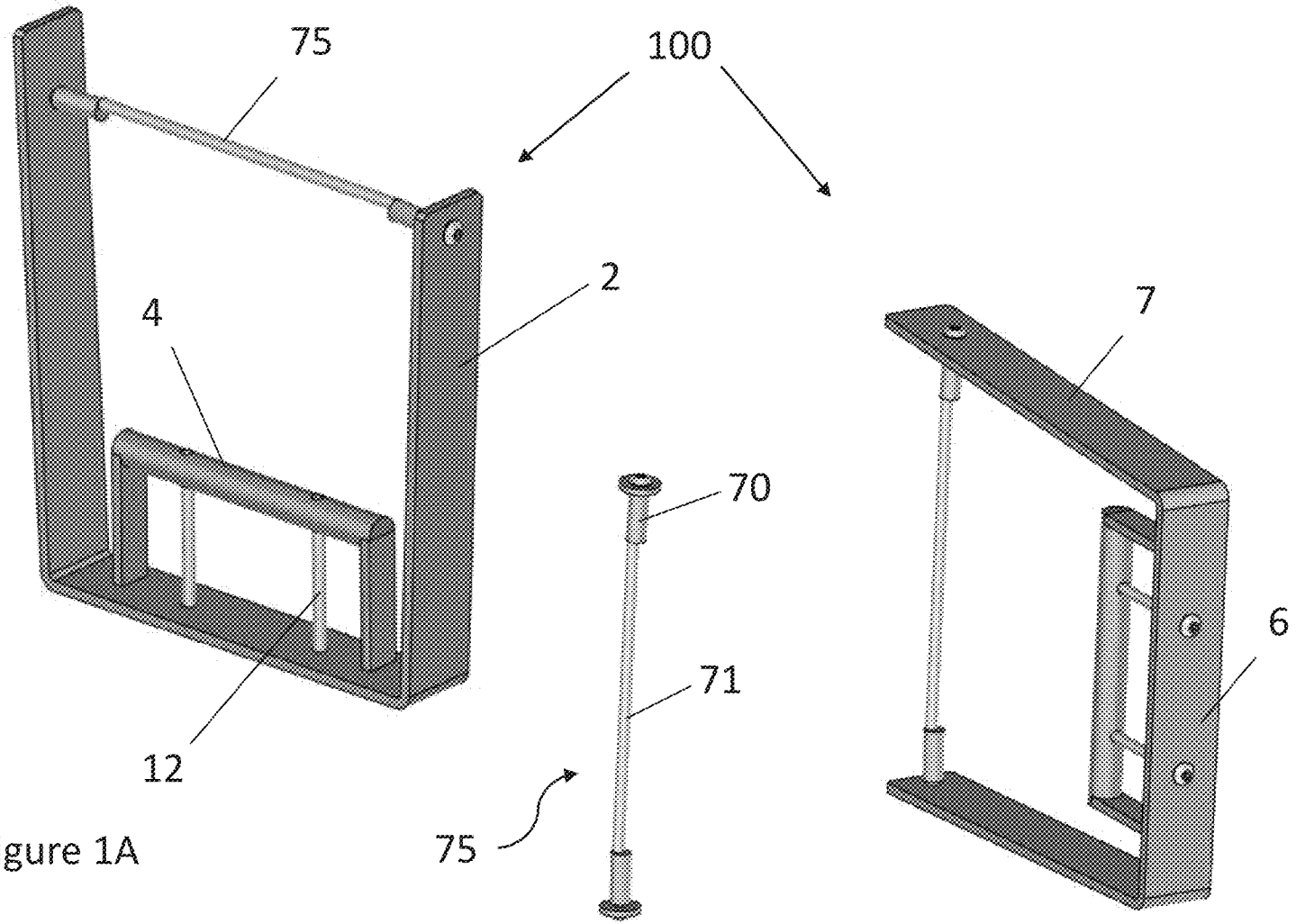
FIG. 1A is a front perspective view of a brace according to the invention.
FIG. 1B is a perspective view of a brace connector from the brace of FIG. 1A.
FIG. 1C is an underside perspective view of the brace of FIG. 1A.

The invention will now be described more fully hereinafter with reference to the accompanying drawings, in which various embodiments, although not the only possible embodiments, of the invention are shown. The invention may be embodied in many different forms and should not be construed as being limited to the embodiments described below.

DETAILED DESCRIPTION OF EMBODIMENTS

With particular reference to FIGS. 1-5, there is illustrated a formwork brace 100 for interconnecting a formwork member 10 and a reinforcement structure 20, comprising: a body 2 configured to partially extend around the formwork member 10; and a plurality of connectors 75, 4 configured to couple together the body 2, the formwork member 10, and the internal reinforcement 20, so that in use the body 2 ties the formwork member 10 to the internal reinforcement 20.

The cross-sectional profile of the body 2 can be configured to correspond to the profile of the formwork member 10 to fit snugly thereabout.

The internal reinforcement structure 20 is located within the formwork member 10, such that the formwork member 10 provides a mould for receiving a fluid concrete mix. The concrete, as a fluid mix, will penetrate the reinforcement structure 20 whilst being retained within the formwork member 10. As the fluid concrete mix cures, the reinforcement structure 20 and formwork member 10 become integrated into a composite construction module 1 which can be used in multiple construction applications (illustrated in FIGS. 5A and 5B).

The brace 100 further comprises a connector illustrated in FIG. 1 as an anchor 4 coupleable to the body 2 for interleaving with the reinforcement member 20. Disposed along a length of the anchor 4 is a pair of bolts 12, inserted through the brace 100 from an exterior of the formwork 10 and being threadingly received within a central member 3 of the anchor 4.

Figures 2A, 2B, 2C, 2D, 2E:
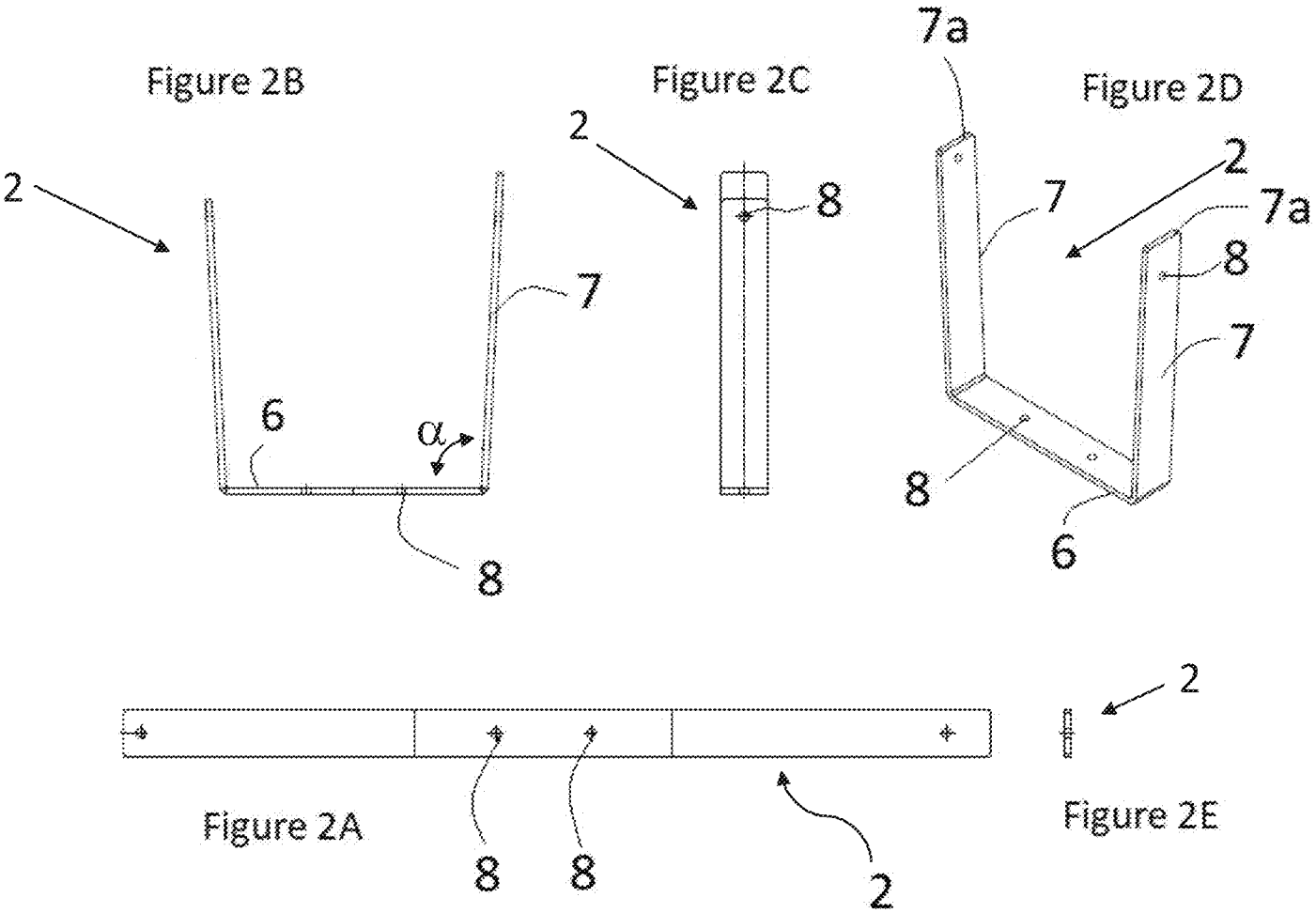
FIG. 2A is a plan view of a body of the brace prior to bending.
FIG. 2B is an end view of the body of the brace of FIG. 2A, after being bent into a desired configuration.
FIG. 2C is a side view of the body of the brace of FIG. 2B in its final configuration.
FIG. 2D is perspective view of the body of the brace.
FIG. 2E is an end view of the body of the brace.

FIG. 2A illustrates the body 2 of the brace 100, as a rectangular blank. The body 2 is about 1400 mm in length, and 75 mm in width. The body 2 is made from 10 mm gauge metal, preferably steel or other similarly strong material. The gauge of the body can be varied to 12 mm, 14 mm, 16 mm, and 18 mm and more if required, depending on the structural reinforcement required for the module 1. The steel can be galvanised or alternatively treated to improve resistance to corrosion and other environmental factors. Other materials can be selected such as Aluminium; however, the gauge of the material may need to be increased to provide the necessary structural strength to the finished module. It is further envisaged that a brace 100 and module 1 can be formed using an aluminium formwork 10 and an alternative pourable substrate, such as a plastic or polymer. This embodiment of the module can be used for lighter weight applications such as pedestrian bridges and walkways.

The dimensions of the body 2 can be varied for use with different sizes of formwork 10. A series of apertures 8 is located along the length of the body 2 for receiving bolts 12, 21 and connectors 75, 4 after the body 2 has been formed into a desired configuration.

FIGS. 2B, 2C, 2D and 2E illustrate the body 2 after bending, in which the body 2 defines a U-shaped configuration. A central portion of the body 2 forms a base 6; and the end portions of the body 2 form a pair or arms 7. The arms of FIG. 2D are not of equal length as a first arm 7 will be located on an outer side of a formwork 10 and a second arm 7 will be located on an inner side of the formwork 10. In some embodiments of the invention, the arms 7 can be of equal length. The arms 7 extend substantially parallel to one another from opposing ends of the base 6.

The arms 7 extend away from the base 6, such that two apertures 8 are equidistantly spaced along the base 6 and an aperture 8 is located towards a distal end of each arm 7. Each of the apertures 8 within the arms 7 are spaced at an equal distance from the base 6, such that these apertures 8 are aligned in the folded body 2.

FIG. 2B illustrates an end view of the body 2, in which the arms 7 are disposed at an angle $\alpha$ from the horizontal base 6. The angle $\alpha$ is just over 90 degrees, approximately 93 degrees. This angle $\alpha$ can be varied to account for the spring-back in the selected material and the load that the brace 100 is intended to support.

Figure 3D:
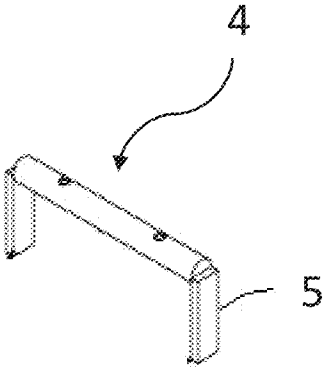
FIG. 3D is perspective view of the internal support of the brace.
Figure 3C:
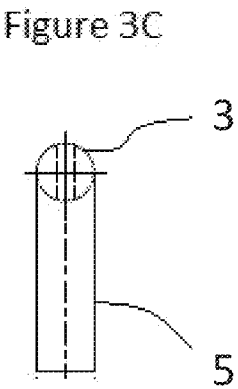
FIG. 3C is a side view of the internal support of the brace of FIG. 3B.
Figure 3A:
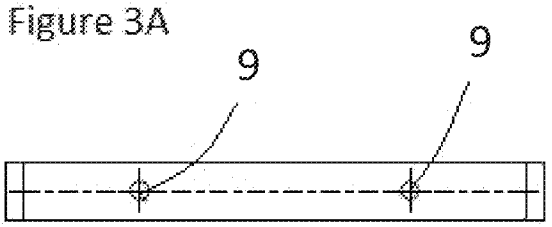
FIG. 3A is a plan view of an internal support of the brace.
Figure 3B:
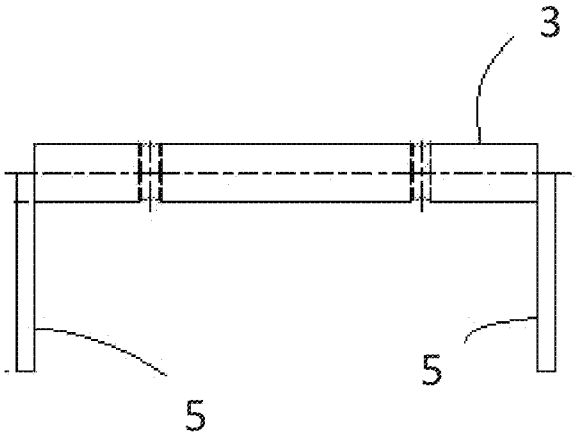
FIG. 3B is an end view of the internal support of the brace of FIG. 3A.

The anchor 4 of the brace 100 is illustrated in FIGS. 3A-3D. FIG. 3A is a top view of the anchor 4, illustrating a central member 3 and a pair of legs 5 disposed at opposing ends of the central member 3.

The central member 3 can be a flat, planar member. In this embodiment, the central member 3 is circular in cross-section having a diameter of about 32 mm. A cylindrical central member 3 will facilitate release of any air bubbles or alternative trapped gases that can form in a concrete solution prior to curing. This can reduce the inclusions and therefore weaknesses within the cured concrete.

The central member 3 comprises two holes 9 which are threaded to receive retaining bolts 12 therein. Additional holes 9 can be introduced to receive additional retaining bolts 12. The central member 3 is about 300 mm in length, and the two holes 9 are spaced about 150 mm apart from each other. The length of central member 3 and the spacing between the two holes 9 can be varied depending on the dimensions of the brace 100 and reinforcement 20, and to vary the loading into the anchor 4. In some embodiments of the anchor 4 a single hole 9 can be used to receive a single bolt 12.

Each hole 9 is drilled to receive an M12 bolt 12. It is contemplated that larger bolts 12 can be employed or smaller bolts 12 depending on the loads to be taken by the brace 100.

The pair of legs 5 can be configured to have a cylindrical form, but are illustrated in FIGS. 3A-3D as flat, rectangular members. Each leg 5 is about 110 mm in length and 32 mm in width. The legs 5 are made from a 10 mm gauge steel or similar structural material. In some embodiments the legs 5 are integrally formed with the central member 3.

The legs 5 can be bolted, welded, glued or otherwise adhered to the central member 3.

The legs 5 are not connected to the body 2 of the brace 100 and act as spacers against the base 6 of the brace 100 to ensure that the formwork 10 is correctly spaced relative to the reinforcement structure 20. The legs 5 thus resist against over-tightening of the bolts 12 and maintain an ideal spatial relationship between formwork 10 and reinforcement structure 20.

The anchor 4 is located within the reinforcement structure 20 and becomes interposed between longitudinal and transverse members of the reinforcement structure 20. As the reinforcement structure 20 is introduced to the formwork 10, the anchor 4 is pivotally adjusted to align the legs 5 towards the base 6 of the body 2, in anticipation of retaining bolts 12 to tighten and lock the anchor 4 in place between the reinforcement structure 20 and the body 2 of the brace 100. FIG. 7B illustrates the anchor 4 in location within the formwork 10 where a predetermined gap g is set below the reinforcement structure 20 to receive concrete (or alternative settable substrate) providing a minimal thickness of concrete around the entire reinforcement structure 20.

Figure 4A:
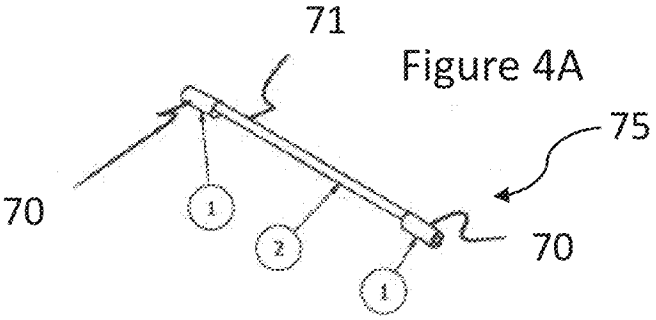
FIG. 4A is a perspective view of a cross-tie of the brace.
Figure 4B:
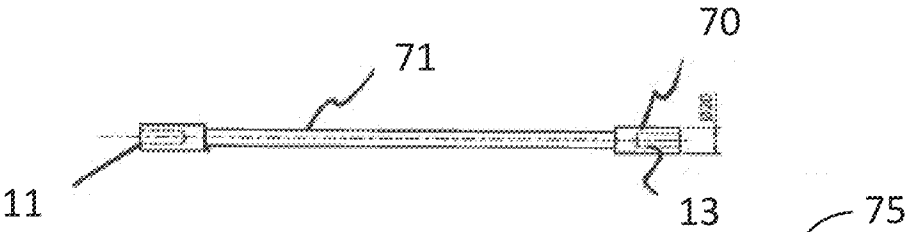
FIG. 4B is a top view of the cross-tie of the brace from FIG. 4A.
Figure 4C:
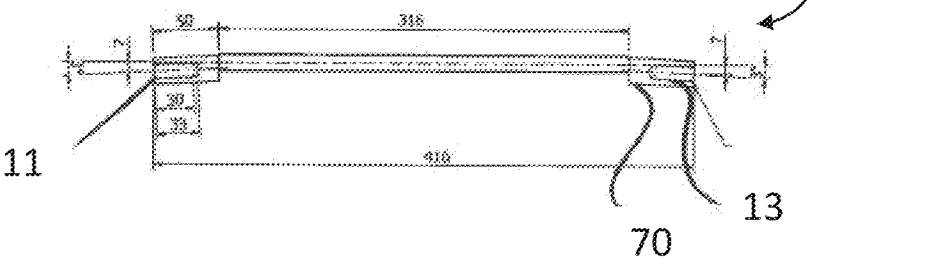
FIG. 4C is a side view of the cross-tie of the brace from FIG. 4B prior to being loaded, illustrating an angular offset at the opposing ends of the cross-tie to conform to the brace.

Returning to FIG. 4, extending across the open arms 7 of the body 2 is a connector illustrated as tie-bar 75; see FIG. 4A-4C. The tie-bar 75 has a pair of end mounts 70 each mount disposed at an opposing end of the tie-bar 75. The mounts 70 will be coupled to the arms 7 of the body 2 through the apertures 8 located towards the distal ends of each arm 7.

The tie-bar mounts 70 provide central apertures 11. The apertures 11 are threaded to receive M12 securing bolts 21. The apertures 11 provide a central, internal bore 13 that is tapped, wherein the bore 13 extends into each mount 70 about 33 mm in depth.

Once the tie-bar 75 is mounted to the brace 100, and the brace is positioned to surround a formwork member 10 and internal reinforcement structure, the tie bar 75 is tightened via each mount 70 to the body 2. This allows the tie-bar 75 to be tensioned drawing the brace 100 about the formwork 10 prior to the introduction of a concrete mix.

As the brace 100 is mounted on the exterior of the formwork member 10, the securing bolts 21 are tightened from the exterior of the formwork member 10 allowing the tie-bar 75 to be tensioned in situ, extending through the reinforcement structure 20. The tightened tie-bar 75 is connected to the open ends 7*a* of each of the arms 7, and thereby tensions the body 2 of the brace 100 applying a load across each of the arms 7, drawing the body 2 inwardly around the formwork member 10. Accordingly, tightening the bolts of the tie-bar 75 reduces the angle $\alpha$.

As illustrated in FIG. 4C, the tie-bar 75 in an un-tensioned state is slightly bowed, such that a centre portion of the tie-bar 75 is further from the base 6 of the body 2. A central axis of each bore 13 is offset from the horizontal by approximately 3 degrees. As securing bolts are tightened into each of the threaded bores 13 at either end of the tie-bar 75, the tension across the central member 71 will pull the two side arms 7 of the body 2 inwardly.

The tie-bar 75 is bowed in the centre by a few degrees to sit flat against the arms 7 of the body 2 on the exterior surface of the formwork. The profile of the formwork 10 is also splayed at a corresponding angle of approximately 3-5 degrees to facilitate nesting of the formwork 10 for transportation.

In some embodiments the tie-bar 75 can be made from a solid bar, eliminating the need to weld or otherwise couple a pair of end mounts 70 to a central beam 71. The ends of the solid tie-bar 75 are drilled and tapped to provide the required threaded bore 13 for receiving a pair of securing bolt 21 therein.

Each mount 70 is cylindrical in shape having a diameter of about 20 mm. A threaded spacer or steel socket can be used to form each mount 70.

The tie-bar 75 has a central beam 71 that spans the pair of mounts 70. The central beam 71 can be manufactured from steel and can be formed from concrete reinforcing bar (re-bar). The rebar beam 71 can be centrally located within the mounts 70. Alternatively, the rebar beam 71 can be offset within the mounts 70 to facilitate a welded connection therebetween.

The central beam 71 is located between the pair of end mounts 70, such that the tapped bores 13 of each mount are facing outwardly in preparation for receiving securing bolts 21 to couple the tie-bar 75 across the body 2.

As the mounts 70 are internally threaded, a securing bolt 21 can be inserted into the aperture 11 and threadingly engaged with the threaded bore 13 through the co-operating apertures 8 in the body 2. This allows the body 2 to be located around the formwork 10 and internal reinforcement structure 20 therein, such that the tie-bar 75 can then be located and secured about or through the reinforcement structure 20. This arrangement also facilitates the tightening (tensioning) of the tie-bar 75 from the exterior of the formwork 10, through the body 2 of the brace 100.

Figures 5A, 5B:
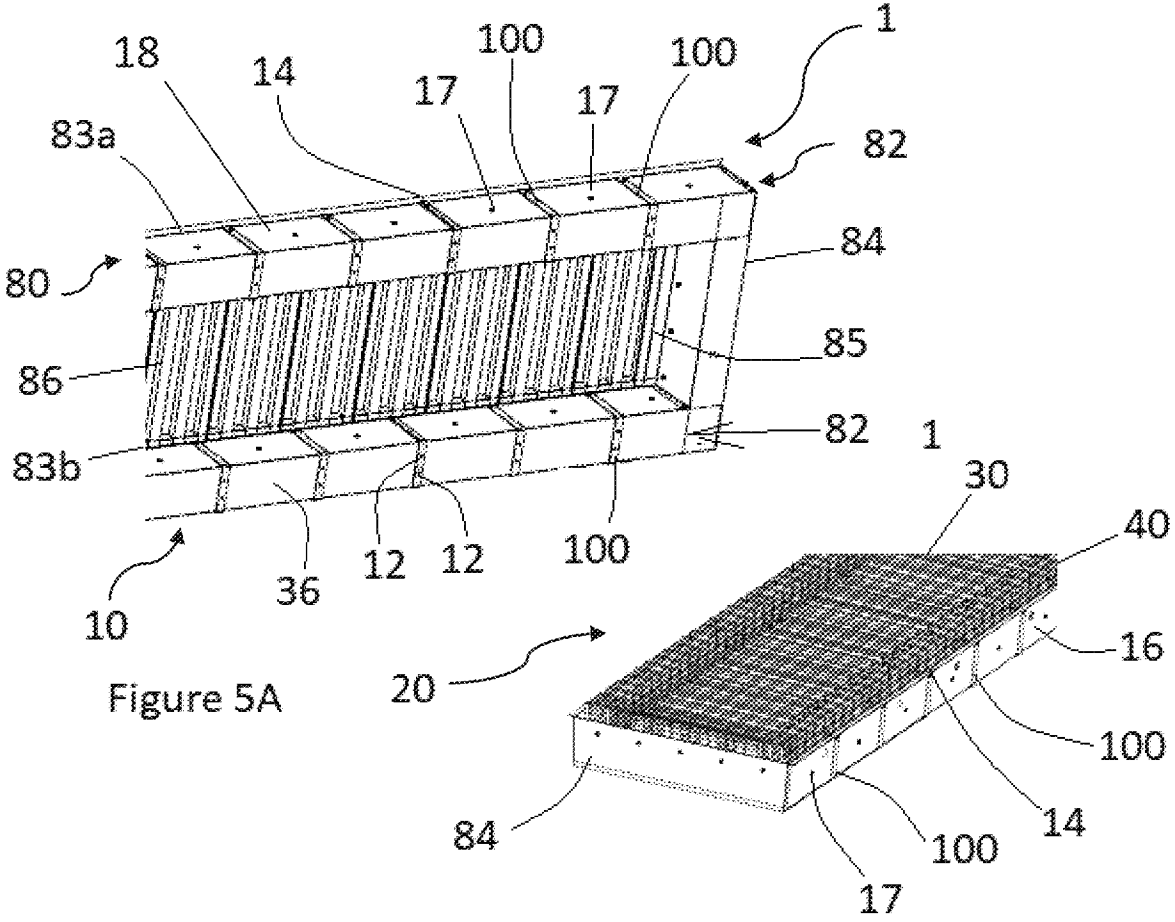
FIG. 5A is a bottom perspective view of a formwork module constructed using the brace of FIG. 1.
FIG. 5B is a top perspective view of the formwork module of FIG. 5A with a reinforcement structure located therein.

FIG. 5A illustrates a module 1 for constructing a structure 110. While the invention is described herein in relation to constructing a bridge, the invention is applicable to other structures, including but not limited to other forms of infrastructure and construction for example; footpaths, roads, road sound panels, short and long span bridges, bridge decks and road, rail tunnels, buildings and high-rise blocks.

With particular reference to FIG. 5A, an embodiment of a module 1 for forming a structure 110 comprises (a) a formwork member 10 that includes a pair of trough segments 82 connected by a stiffening plate 86 (or swaged plate), each trough segment 82 defining a cavity 63 for receiving a reinforcement structure 20 and concrete.

The reinforcement structure 20 includes an upper portion 30 that is formed to extend across the width and along the length of the cavity 63, and at least one lower portion 40 that is formed to extend at least substantially along the length of a lower section of the cavity 63, whereby when the reinforcement member 20 is located in the cavity 63 and concrete fills the cavity 63, the lower portion 40 of the reinforcement member 20 and the concrete thereby define an elongate beam 80.

As the concrete surrounds the reinforcement member 20 from all sides, the formwork 10, the reinforcement 20 and the concrete become integrated into the finished module 1. The load applied to the module 1 in receiving pourable concrete is thus reacted by both the formwork 10 and the reinforcement 20. However, when the concrete has cured thereby forming a steel reinforced concrete, composite structure, a large proportion of the module's working load is supported by the reinforcement structure 20 and the concrete. In the finished module 1, the formwork 10 is not a primary structural member and is not configured to be a load bearing structure. As such, the primary purpose of the formwork 10 is to contain the pourable concrete and to provide a mould while the concrete cures. The formwork 10 can also provide advantages in extending the curing phase of the concrete, keeping the concrete moist within the formwork 10 and thereby increasing the finished strength of the cured concrete.

Along the length of each trough segment 82 a plurality of braces 100 are equidistantly spaced. FIG. 5A is a view from underneath the module 1, and FIG. 5B is a view from above the module 1. The formwork 10 is comprised of two rows of trough segments 82, the two rows spaced apart from one another by the stiffening plate 86 that extends, and is attached, between the two rows.

With a plurality of braces 100 spaced and engaged along the length of the formwork 10, through to the reinforcement structure 20 therein, there is an opportunity to reduce the gauge or grade of the formwork 10 material. This can improve the overall material utilisation of each module 1 with little to no impact on the strength of the finished module 1. Further improvements in material utilisation will be enabled for embodiments of the module where each of the plurality of braces 100 are directly engaged with the stiffening plate 86, together forming an exoskeleton to the module. The exoskeleton of braces 100 and stiffening plate 86 allow localised and tailored stiffening of the formwork 10 in selective areas, thus facilitating a reduction in material thickness (gauge) or strength across the entire formwork 10.

Along the length of formwork 10 a joint seam 14 is illustrated in FIGS. 5A and 5B. The joint 14 is an abutment seam between two adjacent steel sheets, used to form the trough segments 82 of the formwork member 10.

As the module 1 increases in size (length and/or width) the weight distribution of the module 1 changes as does the manner in which loads on the module 1 are reacted. For example, if a module 1 is intended to take high loads in use, the amount of reinforcement in the reinforcement structure 20 can be increased; the grade of the steel used in the formwork member 10 can be increased, the amount of concrete and subsequently, the depth of the trough segments 82 can be increased etc. An engineer will consider each of the above options and the design criteria to assess which is the best solution for a given structure 110. A limitation on these design options is the sizing of sheet steel available for forming the formwork member 10. While the reinforcement structure 20 can be fabricated to any desired size, and the volume of concrete is essentially limitless, the manufacturing capabilities that limit sheet steel production cannot be so easily overcome.

To reduce the impact of this limitation on the module 1, the brace 100 provides a connection means for bringing together and cradling multiple trough segments 82 to form a single formwork member 10. By coupling multiple trough segments 82 together, the limitation imposed by sheet steel sizes can be minimised.

The braces 100 illustrated in FIG. 5A are located about every metre along the trough segments 82, and every third brace 100 is used to couple together two adjacent trough segments 82 proximate a seam 14 and to cradle them about the seam 14.

Figure 9:
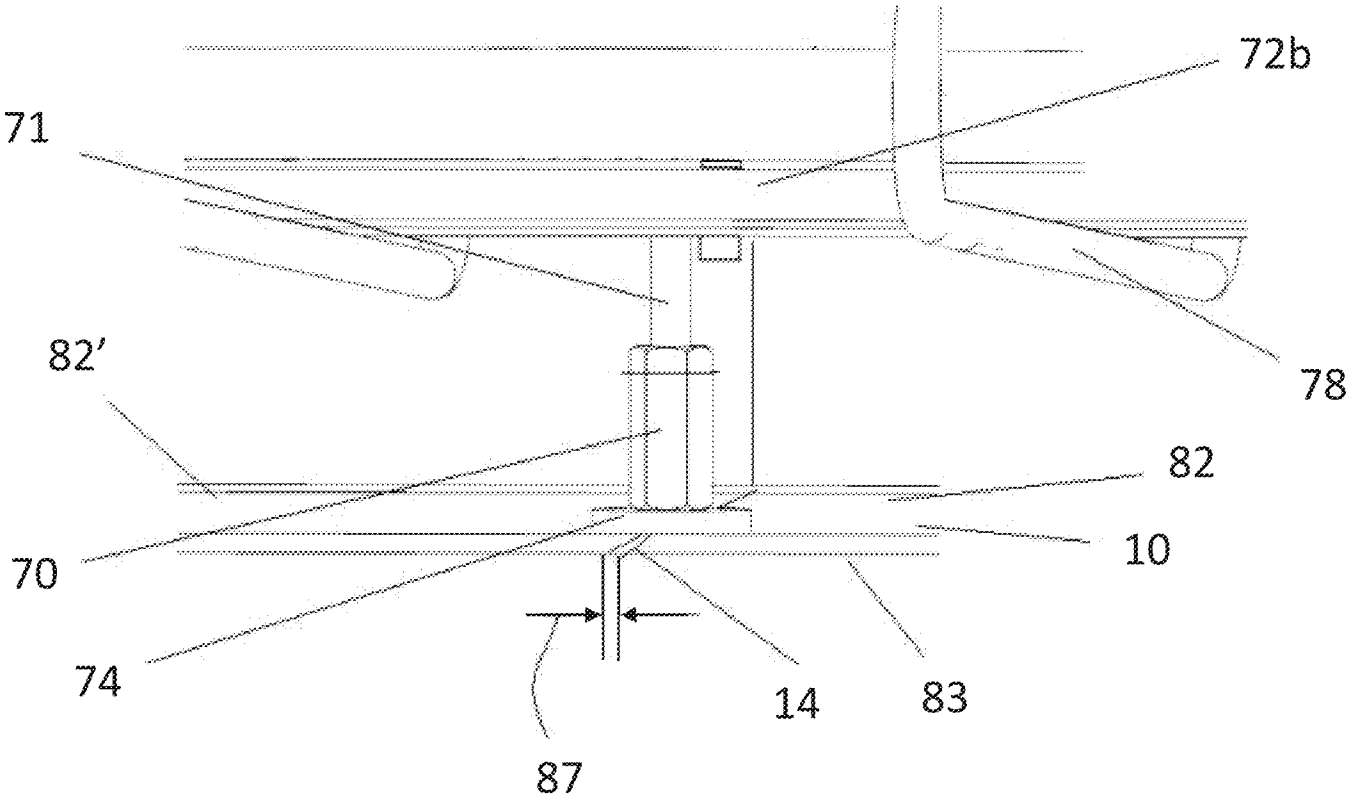
FIG. 9 is an illustration of a cross-tie mounted to an internal surface of the formwork, extending through a reinforcement structure.

The tie-bar 75 described herein can be used to tension (i) across each trough segment 82 and at various positions along the length, and (ii) between abutting trough segments 82. This reduces the opportunity for any fluid concrete to seep between adjacent trough segments 82 prior to curing. FIG. 9 illustrates an internal view of the joint seam 14 between two segments having a brace 100 (not illustrated) on an outer side of the joint seam 14.

FIG. 5B illustrates an upper reinforcement 30 and a lower reinforcement 40 located within the formwork member 10 ready to receive a concrete mix. Between each brace 100 an intermediate connector 17 is visible, extending through the side walls 16 of the trough segments 82. The intermediate connector 17 can be configured in the same manner as the tie-bar 75 and is located across the trough segment 82, through the internal reinforcement structure 20. The intermediate connector 17 is not coupled to the reinforcement structure 20 (see FIG. 6). It is contemplated that in some embodiments the intermediate connector 17 can be coupled to the reinforcement structure 20.

The intermediate connector 17 couples an outer side wall 18 of the trough segment 82 to an inner side wall 19 of the trough segment 82 and is not coupled through a brace 100. As such the intermediate connector 17 is tensioned (and is loading) across the trough segment 82 only. Where increased working load is required in the module 1, additional braces 100 can be used to couple the intermediate connectors 17, thereby increasing the working load of the module 1.

The module 1 is designed to use 40 MPa concrete, by way of example, which is readily available. This is also a suitable concrete for the formation of abutments with which to support the modules 1, in constructing the structure 110.

Illustrated in FIG. 5A, the formwork 10 includes two spaced apart rows (or elongate beams), each row comprising a plurality of trough segments 82. The two rows are connected to one another with a stiffening plate 86, and two end caps 84 disposed at opposing ends of the formwork 10. An additional mid-span cross beam (not illustrated) can also be incorporated to traverse the stiffening plate 86 (this cross beam will reduce twisting between the two rows thus making the formwork 10 stronger and more rigid).

The trough segments 82 are roll formed or pressed from galvanized steel to form a U-shaped section. Each trough segment 82 extends from about 1.2 m to approximately 3 m in length. Each 3 m trough typically weighs about 100 kg. The periphery of the U-section has two opposing horizontal flanges 83*a*, 83*b*. An outer flange 83*a* is configured to engage the side structure on an outer side of the module 1 and an inner flange 83*b* is configured to engage and support the stiffening plate 86. The depth of each trough segment 82 can be adjusted to provide additional strength and bending resistance depending on the desired span of the bridge and/or load capacity of the structure 110.

The stiffening plate 86 is mounted on opposing sides to the flanges 83*b* of the two rows of trough segments 82. The stiffening plate 86 can be welded, riveted, bolted or bonded to the troughs to form a W-section. Along a base 36 of each of the trough segments 82 are disposed a plurality of holes (not illustrated) for inserting retaining bolts 12 to be threadingly received by the central member 3 of the anchor 4. This arrangement facilitates the insertion of the reinforcement structure 20 into the trough sections 82, before the retaining bolts 12 are inserted into the anchor 4 to anchor the trough base 36 to the reinforcement structure 20. In this manner the reinforcement structure 20 adds to the stiffness of the formwork 10 before concrete is introduced to bond the two together.

The two end caps 84 are roll-formed or pressed to form a mounting flange 85. These end caps 84 are then welded, riveted, bolted or bonded to the trough segments 82 and stiffening plate 86 to complete the formwork 10. It is contemplated that additional rows of trough segments 82 can be used to construct the formwork 10, such that two, three, four or even five rows of trough segments are interconnected with stiffening plates 86, each configured to receive a portion of the reinforcement structure 20 and thereby create up to five elongate beams 80 across the module 1.

Figure 6:
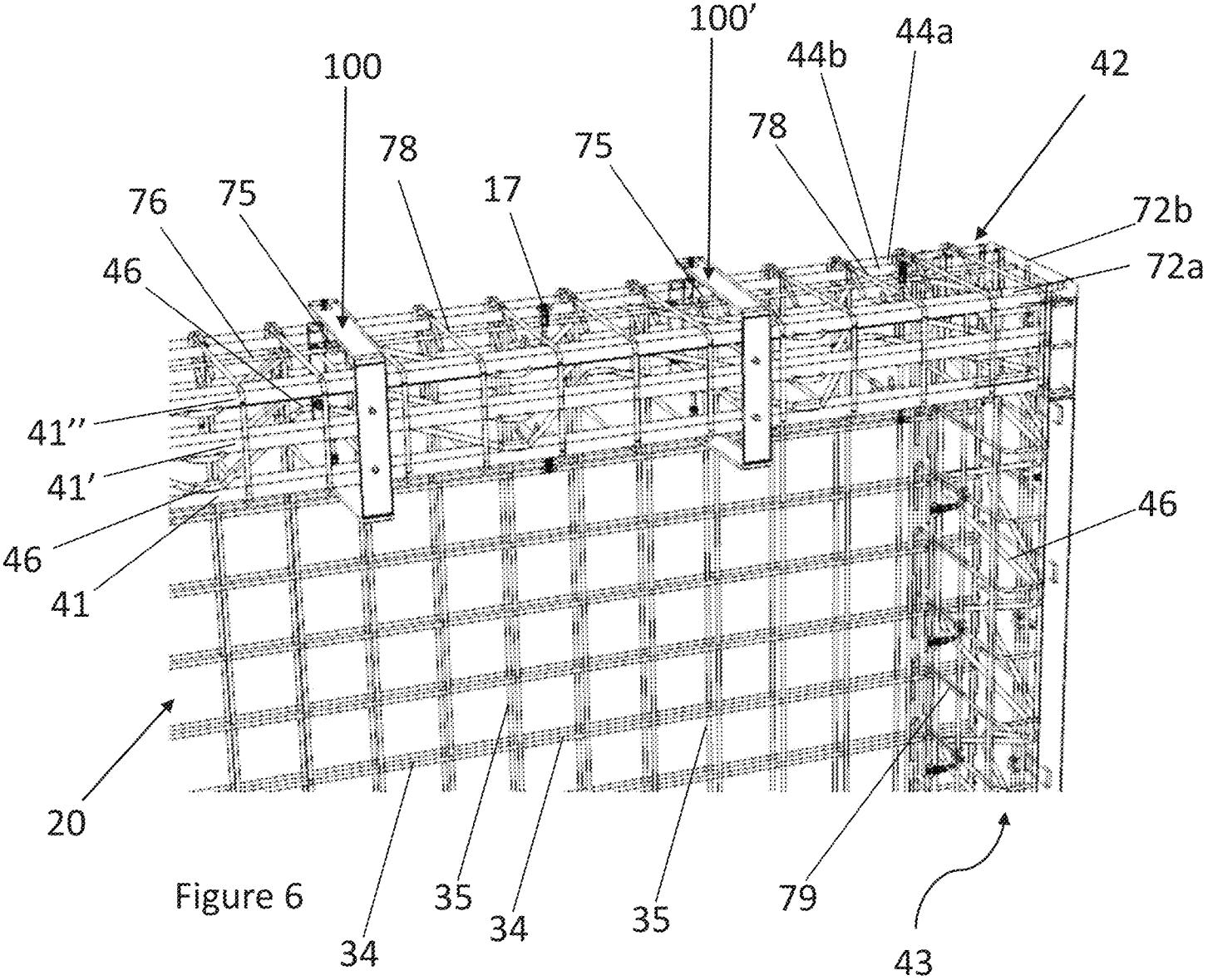
FIG. 6 is a perspective view of the reinforcement structure of FIG. 5B, with the formwork removed, illustrating the interconnectivity between the brace and the reinforcement structure.

FIG. 6 is an enlarged view of the upper 30 and lower reinforcement 40 in position within the trough segment 82 of the module 1 from FIG. 5B, with the formwork member 10 (all trough segments 82) removed. In this view the location of the brace 100 and the interleaving relationship of the brace 100 (and anchor 4) with the reinforcement structure 20 is more clearly illustrated.

The reinforcement member 20 is constructed from the upper reinforcement 30 and the lower reinforcement 40.

The upper portion 30 is formed from a double layer of mesh, illustrated in FIG. 6. The mesh comprises a lattice work of line-wires 34 and cross-wires 35, wherein the line wires traverse the cross-wires substantially perpendicularly thereto.

The lower reinforcement member 40 received within the trough segments 82 is comprised of a plurality of frames 41, 41', 41" that form a truss 42.

Each frame 41, 41', 41" comprises an upper longitudinal member 44*a* and a lower longitudinal member 72*a* and an intermediate member 46 that traverses back and forth between the pair of longitudinal members 44*a*, 72*a*.

The intermediate member 46 extends diagonally between the pair of longitudinal members 44*a*, 72*a* to structurally reinforce, and stiffen the frame 41. The intermediate member 46 is permanently engaged with the longitudinal members 44*a*, 72*a* at multiple connection points along the length of the frame 41. The engagement member 46 can be bolted, or welded to the longitudinal members 41. From a side view of the frame 41, the intermediate member 46 defines a sinusoidal waveform traveling along the length of the frame 41.

Each frame 41 is arranged in spaced relationship across the lower portion 40 of the reinforcement member 20.

The reinforcement structure 20 can be fully constructed and rigorously tested to structural and safety standards to be certified independently of the formwork member 10. The testing can be carried out away from the construction site, meaning that the reinforcement structure 20, once installed in the formwork member 10 need not be certified or tested further. The mixing and integrity of the concrete are the only variables to be managed at the installation site. This can be advantageous, where a structure 110 is to be constructed in a remote location that is hard to reach or in an area where architects and other qualified professionals are in short supply for certification purposes.

As each frame 41 is comprised of a pair of outer longitudinals 44*a*, 72*a* and an intermediate member 46, the strength of the frame 41 is not constant along its length.

To rectify this varying strength along the length of the frame 41, 41', 41" the intermediate member 46 of each frame is displaced relative to an adjacent frame 41, 41', 41". In this manner the strength of the overall truss 42 is more consistent.

The reinforcement structure 20 can be jigged for dimensional tolerance and control of the fabrication and assembly process. The finished reinforcement structure 20 will be tested and certified before being dispatched to the structural 110 installation sites.

As the concrete cures around the reinforcement structure 20 binding it to the formwork member 10, the anchor 4 and tie-bar 75 of each brace 100 become affixed within the module 1.

When fabricating the reinforcement structure 20 the trusses 42 and frames 41 can be positioned or temporarily affixed to a jig in order to set the dimensional tolerances of the overall reinforcement structure 20. It is further contemplated that the jig can be configured such that the finished reinforcement 20 is pre-tensioned as it is fabricated. When removed from the jig or fixture, the reinforcement structure 20 will remain pre-tensioned when placed in position within the formwork member 10. This will ultimately provide a pre-tensioned module 1 from which to construct a structure 110.

The reinforcement structure 20 can be transported to the structure 110 installation location in isolation or in combination with the formwork members 10. The two components (reinforcement 20 and formwork 10) are designed to cooperate with one another and as such, nest well for transportation when shipped from a single manufacturing source.

As described above, each module 1 provides a form of integrated truss 42 within each module 1. The formwork member 10 is light and transportable, thus reducing transport costs. Once in situ, the reinforcement member 20 is combined with the formwork member 10 and located therein. Once both the formwork member 10 and the reinforcement 20 are in position the connections to the brace 100 are secured; the retaining bolts 12 are driven through the base 36 of the trough segments 82 to connect with adjacent anchors 4 and thereby set the reinforcement structure 20 relative to the formwork 10, and the tie-bars 75 are threaded through the reinforcement structure 20 to tension the arms 7 of each brace 100. At this time, concrete in pourable form is added into the formwork tray 10 to surround the reinforcement structure 20 and complete the module 1. The concrete as it cures and sets, integrates the reinforcement structure 20 and the braces 100 into the formwork member 10, thereby strengthening the module 1.

The truss 42 of FIG. 6 is subject to significant loads. The full reinforcement structure 20, for a 12 m long module, can weigh up to 3300 kg by way of example. The reinforcement 20 for an 18 m long module can weight up to 6500 kg. As the upper 30 and lower 40 reinforcements are combined whether by welding or adhesives, the trusses 42 must withstand the loads thereon. Secondary supports can be incorporated into reinforcement structure 20 to counteract these loads and resist torsion and bending before attachment to the formwork 10.

Illustrated in FIG. 6 are a number of secondary supports. The upper longitudinal member 44*a* has been duplicated to provide a lower reinforcement 44*b*. Further, the lower longitudinal member 72*a* has been provided in a U-shaped configuration, illustrated as a longitudinal member 72*a* having a cog, or hooked end. The member 72*a* has a duplicated, parallel longitudinal rail 72*b* that extends the entire length of the truss 42. The hooked ends of member 72*a* are up-turned by 90 degrees to form the hook. This configuration of member 72*a*/72*b* provides additional shear reinforcement transverse to the flexing of the trusses 42. The member 72 having hooked ends further provides reduction in the deflection of the formwork 10 when subjected to bending loads.

A ligature reinforcement 78 is wound around the truss 42 constraining the frames 41 from separating from one another under load. These ligatures 78 are peripheral to the truss 42 and are repeated at spaced intervals along the length of the truss 42.

The member 72*a* is of a greater cross section to that of both the ligature 78 and a central brace beam 76. The member 72*a* is between 30-50 mm in diameter. In contrast the ligature 78 and central brace beam 76 are between 10-20 mm in diameter. It is contemplated that these secondary supports are made from steel or similar high tensile material.

FIG. 6 illustrates further secondary supports incorporated into an end portion of the lower reinforcement. A ligature 79, similar to that of the longitudinal ligature 78 is introduced to support end portions of the lower reinforcement 40, creating an end truss 43. The ligature 79 is wrapped around a plurality of cross wires 35 that extend at intervals through the thickness of the reinforcement structure 20, effectively spanning the upper 30 and lower reinforcement 40. The ligature 79 also embraces multiple cross wires 35 across the reinforcement to give width and depth to the end truss 43. As with the longitudinal ligatures 78, the ligatures 79 can be joined to the cross-wires at points of intersection. In this manner the ligatures 79 create an end truss 43 and resist the separation of the cross wires 35 under load.

In FIG. 6, the lower longitudinal members 72*a* are illustrated passing beneath the central member 3 of each anchor 4 of each brace 100. As the retaining bolts 12 are threaded through each brace 100 and the formwork 10, they are received in the apertures 9 of the central member 3 of the anchor 4 and engaged thereto. This tightens the base 36 of the trough segment 82 to the reinforcement structure 20, strengthening the overall structure and tensioning the formwork 10 to receive the concrete mix. The legs 5, as previously described, also serve to locate the reinforcement structure 20 relative to the base 36 of the trough segment 82.

Figure 7A:
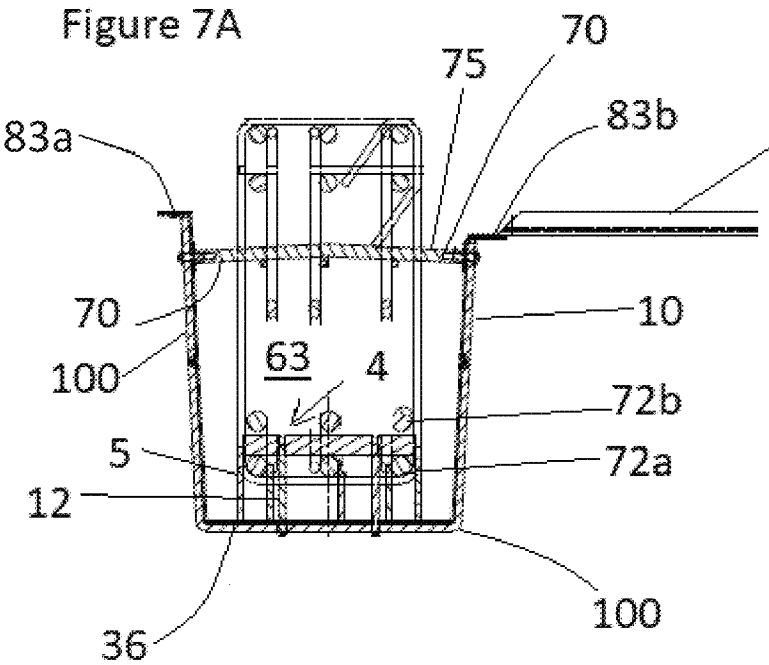
FIG. 7A is a cross-sectional view through a portion of the formwork module from FIG. 6.
Figure 7B:
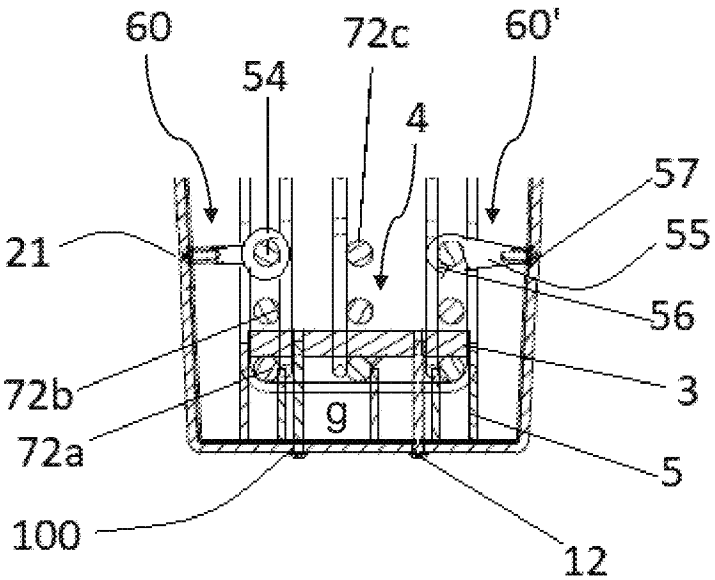
FIG. 7B is an enlarged view of the internal support in connection with the reinforcement member from FIG. 7A.

A cross-section through a trough segment 82 is illustrated in FIG. 7A. The tie-bar 75 and the anchor 4 hold the formwork 10 in the correct location about the structural reinforcement 20. Effectively, tie-bar 75 limits the formwork 10 from falling below the structural reinforcement 20, while opposing the tie-bar 75. The anchor 4 sits between the lower longitudinal members 72*a* and 72*b*, such that the anchor acts against both.

When at rest on the ground, the anchor limits upward movement through 72*b*. When the reinforcing is supporting the weight of the formwork and/or concrete, the anchor supports the formwork by being caught by 72*a*. The anchor 4, and thus the formwork 20 is held up by the lower longitudinal members 72*a* against the underside of the central member 3 to set the gap between the base 36 of the trough segment 82 and the reinforcement structure 20.

Figure 7D:
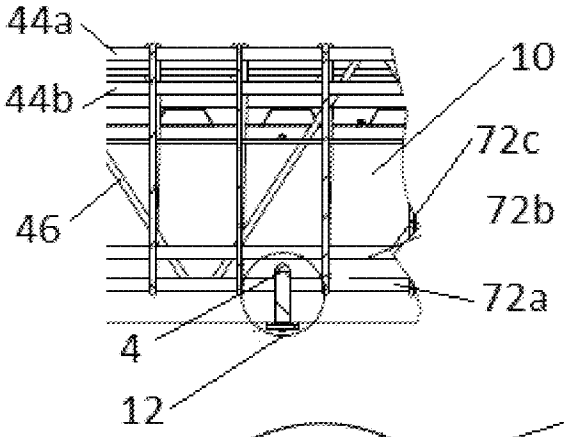
FIG. 7D is a cross-sectional side view of a formwork member from inside the cavity, illustrating the anchor.
Figure 7E:
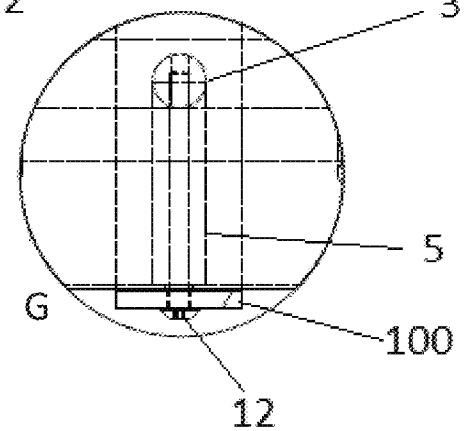
FIG. 7E is an enlarged view of the circle G in FIG. 7D, illustrating the anchor mounting to the brace through the formwork member showing a dashed representation of the brace location on the outside of the formwork.
Figure 7C:
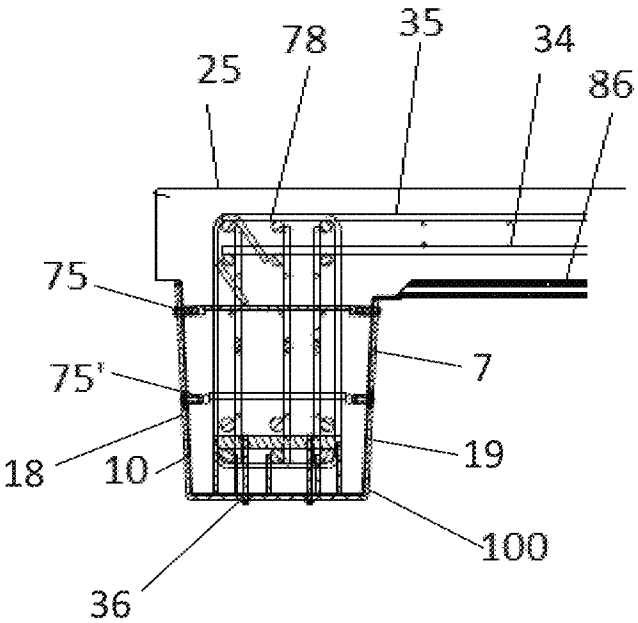
FIG. 7C is a cross-sectional view through the formwork and reinforcement structure, illustrating the location of two cross-ties through the reinforcement structure.

FIGS. 7B and 7C illustrate a supplemental connector 60, 60', 60" between the brace 100 and the reinforcement structure 20.

In FIG. 7B a first supplemental connector 60 is illustrated as a ringtail bolt 54. The ringtail bolt 54 is illustrated in more detail in FIG. 7F. The ringtail bolt 54 comprises a mount 58, a spiralling shank 59 and a threaded end 37. The threaded end 37 is located proximate to the formwork member 10 in alignment with an arm 7 of the brace 100. The threaded end 37 is received in the mount 58. The mount 58 is tapped and threaded on opposing ends to receive a securing bolt at a formwork facing end 58*a* and to receive the threaded end 37 of the ringtail bolt 54 at the reinforcement facing end 58*b*.

The elongate, spiralling shank 59 of the ringtail bolt 54 allows the bolt to be twisted into engagement with the longitudinal member 72*c*. The ringtail bolt 54 can be threaded in between the members of the reinforcement structure 20 and twisted into engagement with a selected member. Once the shank 59 is encircling the desired member (72*a*, 72*b*, 72*c*) the threaded end 37 of the ringtail bolt 54 is coupled to the end 58*b* of the mount 58. A securing bolt 21 is inserted into the mount end 58*a* from an external side of the brace 100 and formwork member 10, and tightened to tension the ringtail bolt 54 tightening the brace 100 around the reinforcement structure 20 and formwork member 10.

FIG. 7B illustrates an alternative embodiment of a supplemental connector 60' as a hook 55.

The hook 55 is elongate and planar. The hook 55 provides a mounting hole 57 at an end proximate the brace 100, to receive and capture a securing bolt 21. At a distal end of the hook 55 is a circular aperture 56 for receiving a longitudinal reinforcement member 72*c*. The mounting hole 57 and the circular aperture 56 are located on planes substantially perpendicular to one another. The hook 55 acts as a spacer between the formwork 10 and the reinforcement structure 20, locating the two, prior to the introduction of concrete thereto.

FIG. 7C illustrates a further supplemental connector, configured as a tie-bar 75'. Tie-bar 75' is constructed in a similar manner as described herein in relation to tie-bar 75, having a shorter length of central beam 71 to adapt to a width between the pair of arms 7 of the body 2, in this location. As with tie-bar 75, this tie-bar 75' can be inserted through the reinforcement structure 20 and bolted and tightened (tensioned) through the brace 100 from an external side of the formwork member 10.

FIG. 7D is a cross-sectional side view of the formwork member 10 from inside of the cavity 63, illustrating the anchor 4.

Figure 7G:
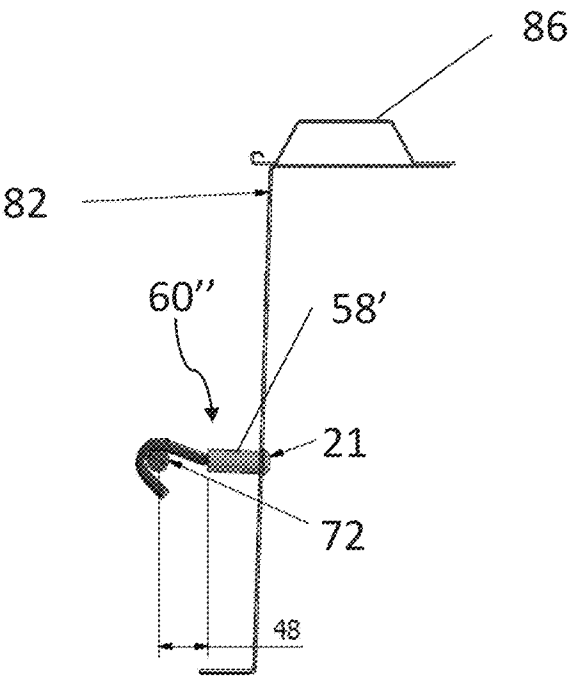
FIG. 7G is a side view of the formwork, illustrating an embodiment of a connector for coupling the external brace to the reinforcement structure within the formwork.
Figure 7F:
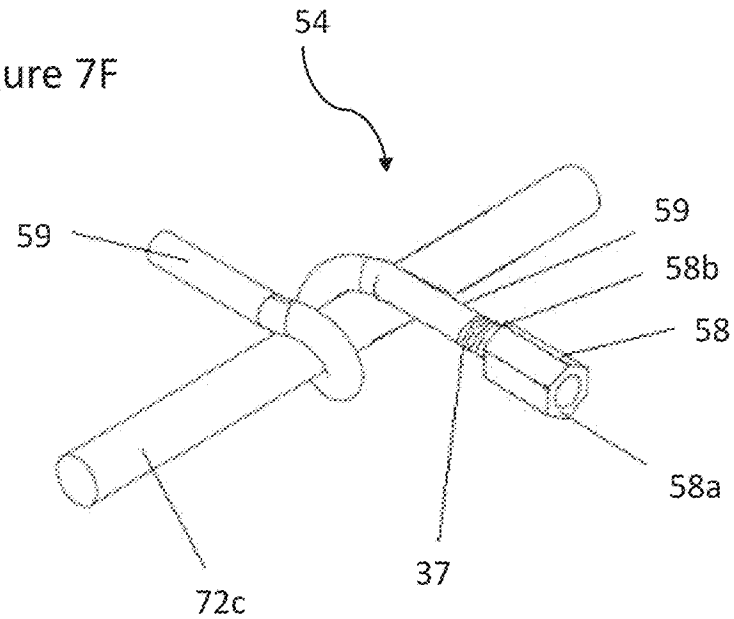
FIG. 7F is a perspective representation of a ringtail bolt for coupling the formwork member to the reinforcement structure.

An enlarged view of circle G from FIG. 7G is illustrated in FIG. 7E, illustrating a dashed representation of the brace's 100 location on the outside of the formwork 10. Specifically, FIG. 7E shows the externally located brace 100 and retaining bolt 12 inside the cavity 63 of the formwork 10 to couple the anchor 4 and the reinforcement structure 20, through the formwork 10.

FIG. 7G is a side view of a further embodiment of a supplemental connector 60" having a hook 55' and an internally threaded mount 58'. The hook 55', in use, is located on the inside of the formwork 10 and couples to the internal reinforcement structure 20. The internally threaded mount 58' is aligned with an aperture in a side wall of the trough segment 82 and a securing bolt 21 is inserted from the outside of the formwork. The bolt 21 is tightened to retain the connector 60" in place and tension the connector 60". The side wall of the formwork is then correctly positioned relative to the reinforcement structure 20 in anticipation of receiving the settable concrete to integrate the components of the module 1.

The brace 100 can be used to support blocks (not illustrated) within the cavity 63, such that voids are formed in the concrete as it cures. These blocks can be made of light weight material for example, foam or plastic, such that the overall weight of the finished module 1 is reduced. The support blocks can be positioned at locations within the module where module strength is not affected by the reduction in localised concrete volume.

Figure 8A:
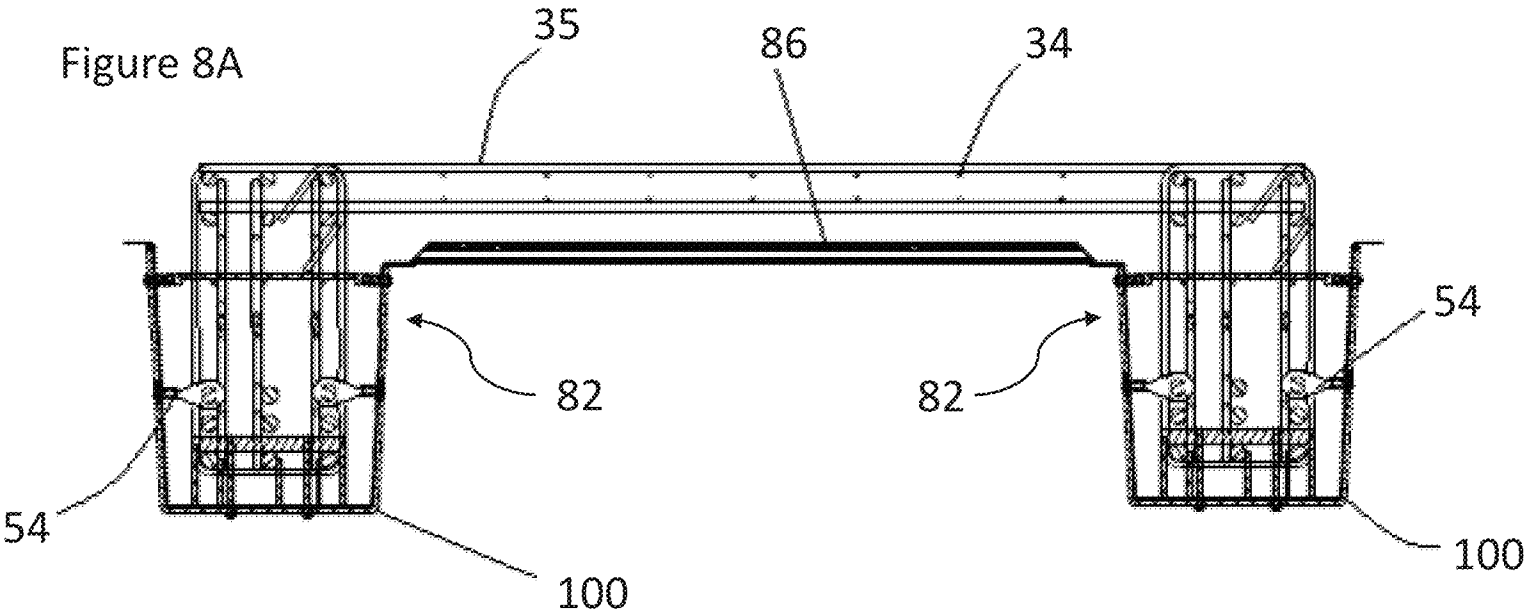
FIG. 8A is a cross-sectional view through a whole formwork module, illustrating an alternative connector to the cross-tie.
Figure 8B:
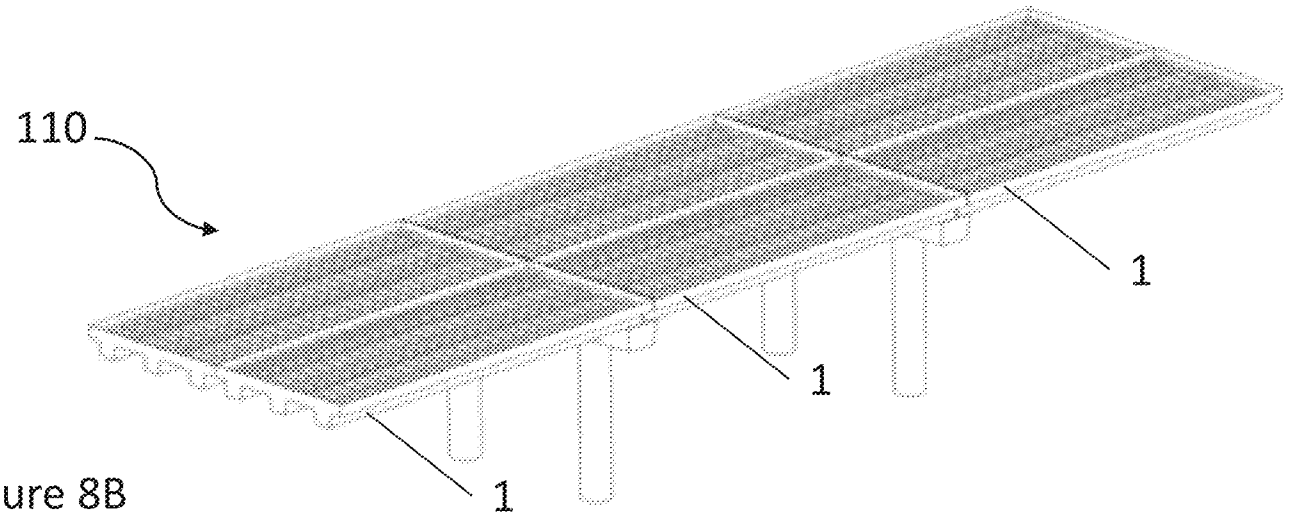
FIG. 8B is a structure, in the form of a bridge, constructed from a plurality of formwork modules in both side-by-side and end-to-end spaced relationship.

FIG. 8A illustrates a cross-section through an entire module 1, using ringtail bolts 54 as supplemental connectors 60. When a plurality of modules are interconnected end-to-end and/or side-to-side a bridge structure 110 is formed, as illustrated in FIG. 8B. It is further contemplated that for short spans, a single module 1 could be used to form bridge structure 110.

Figure 8C:
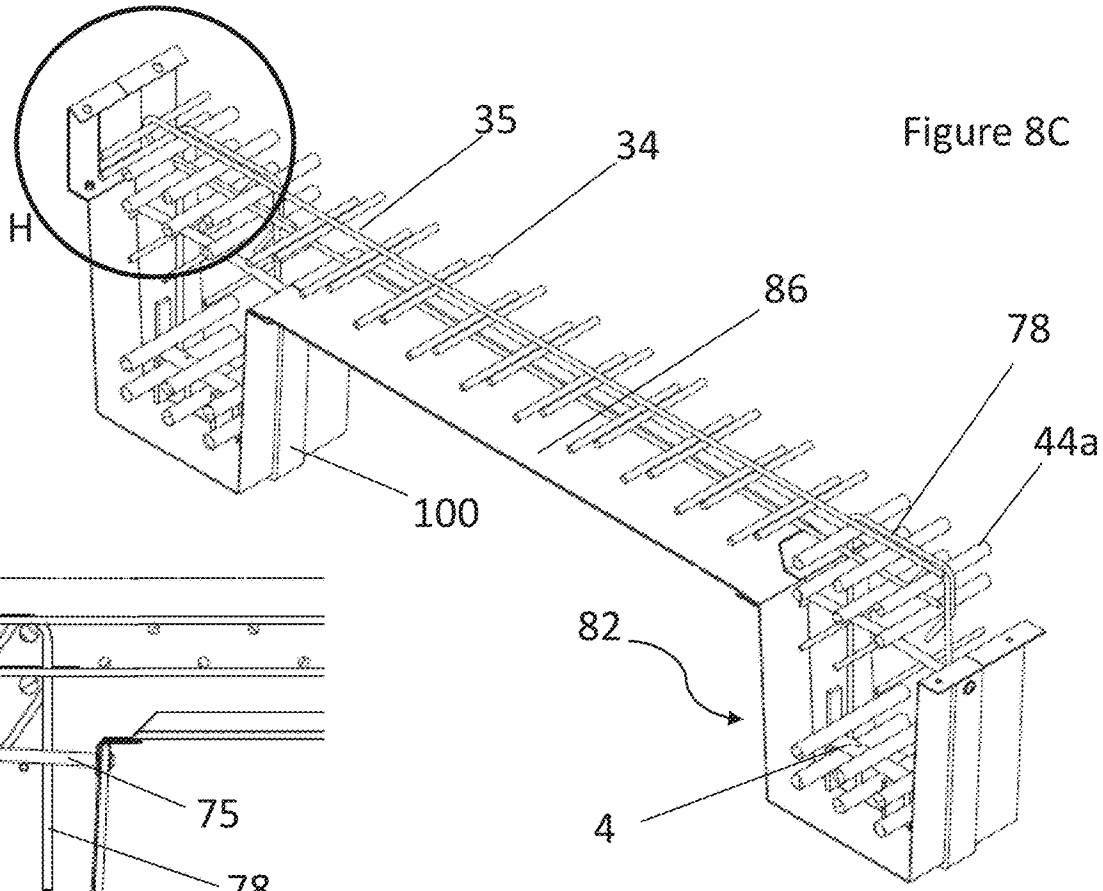
FIG. 8C is a perspective view of a portion of a formwork structure, illustrating the interaction between the internal reinforcement and the brace.

FIG. 8C is a perspective view of a portion of a formwork structure, illustrating the interaction between the internal reinforcement and the brace; and the engagement between the reinforcement through the troughs 82 and the reinforcement members 34, 35 through the deck. The encircled area H is illustrated schematically in FIG. 9, showing the seam or joint 14 between consecutive troughs which is pulled to close the gap 87 by the weight of the reinforcement and concrete, introduced into the module.

Figure 8D:
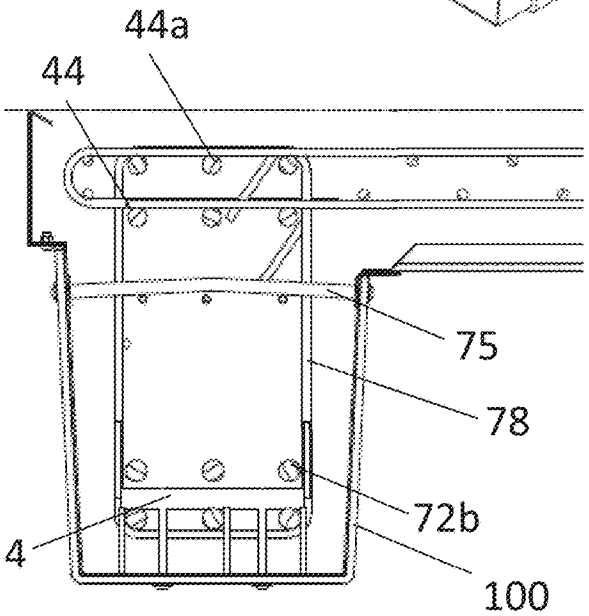
FIG. 8D is a cross-sectional view through one half of a formwork module, taken through the centre of an internal brace within the trough.

FIG. 8D is a cross-sectional view through one half of a formwork module, taken through the centre of an internal brace, anchor 4 within the trough 82, illustrating the external brace 100 and anchor 4 interconnected within the formwork module. Also shown in FIG. 8D is the interaction between the tie-bar 75 and the reinforcement 20. The reinforcement structure 20 can be located in the formwork member 10 when the reinforcement 20 and formwork member 10 are to be transported simultaneously. The ability of the components to nest is advantageous. The dimensions of the modules 1 are such that three modules 1 can be packaged into a shipping container. In some embodiments the modules 1 can be joined together using a removable frame (not illustrated), to be transported in the format of a shipping container, without the external protection/coverings of a container: this form or packaging is more suitable for local and national destinations.

This facilitates transport of the modules 1 over great distances. The reinforcement 20 is protected by both the shipping container and the formwork members 10. Furthermore, the available resources for transporting shipping containers, whether by sea or by land, can be easily applied to the transportation of modules 1. Packing the modules 1 into a container facilitates transport and handling of the modules 1, resulting in significant transport cost savings and enabling the modules 1' to have a global reach. After the modules 1 arrive at the construction location, the modules 1 are manoeuvred into their predetermined positions, ready to receive the wet concrete mix.

It is contemplated that each of the frames 41 can be sold in kit form, to provide for assembly in a secondary location, after manufacture. This provides flexibility and packaging advantages for shipping and transportation of the frames to a location where the reinforcement structure 20 is to be constructed.

It is further contemplated that each trough segment 82 and each brace 100 can also be sold and delivered in a kit form to allow local tradesmen and local manufacturing to construct these components. In this manner, local economies can benefit from being involved in the construction process, not only stimulating local industry but investing local people in the construction and final structure 110.

FIG. 9 illustrates the interior of a trough segment 82, with the reinforcement structure 20 located within the formwork 10. The brace 100 cannot be seen in this view, as the brace 100 lies on the outer side of the formwork 10.

The tie-bar 75 is illustrated having a central beam 71 comprising rebar. The end mount 70 comprises a metal socket, to which the central beam 71 has been welded. The mount 70 further comprises a washer 74 disposed between the socket and the formwork 10 to more evenly spread the load onto the formwork 10.

Extending approximately centrally behind the washer is the joint 14 between the two adjacent trough segments 82. The joint 14 can be seen where the two adjacent trough segments 82 touch along their bases 36, however, a gap 87 is illustrated where the joint 14 reaches the upper flange 83 of the formwork 10. As the concrete mix is added to the formwork 10, the weight of the concrete mix is reacted through the bases 36 of the trough segments 82 of the formwork 10. This load is applied across the base of the module 1, which pulls the central trough segments 82 downwards, pulling together the gap 87 as the formwork 10 is filled. Once the concrete cures and the module 1 is completed, the gaps 87 between adjacent trough segments 82 have been closed, sealing the formwork member 10.

Figure 13:
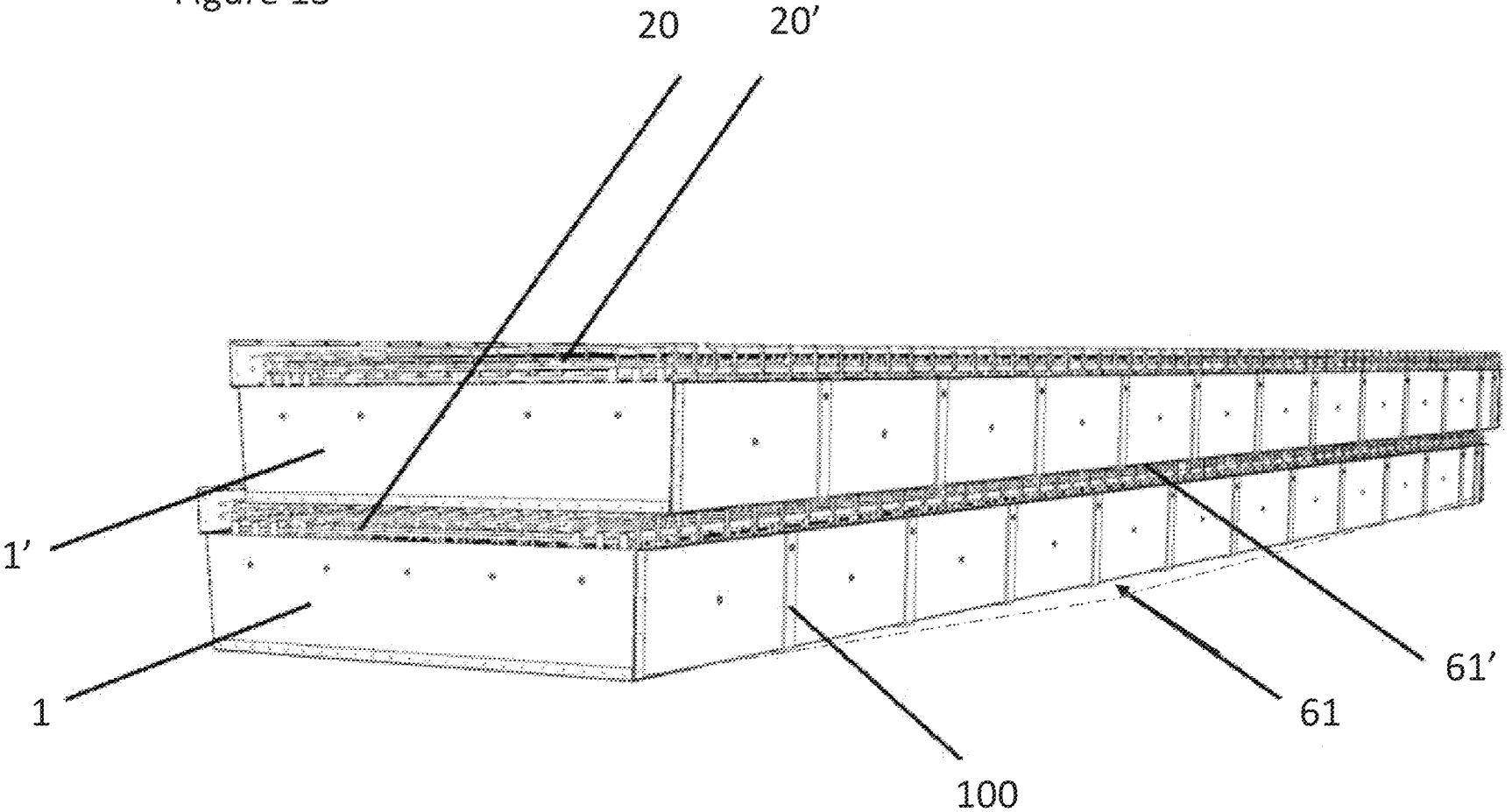
FIG. 13 is a perspective representation of a pair of formwork modules each having a reinforcement structure therein, illustrating a camber along the length of each module, prior to the introduction of concrete into the module.

FIG. 13 illustrates a camber along the length of each of a pair of formwork modules 1, prior to the introduction of concrete into the modules 1. Over a 12 metre span a 50 mm gap 61 is created at a centre point of the formwork 10, the centre point being 50 mm above the height of the opposing ends of the formwork 10, such that the weight of concrete introduced into the formwork 10 will pull the base 36 of the formwork 10 downwardly to create a substantially flat bottom to the finished, cured module 1, closing the gap 61.

The module 1 is standardised, pre-engineered and pre-certified, and as such can be mass-produced off-site. It can then be transported globally within a shipping container, and stored in a depot for rapid deployment to maintain efficient construction timelines, and for emergencies. The product is designed to use locally available resources such as light-weight cranes and easily-available concrete (N40 strength). The bridge 100 further provides a multitude of structural and logistical advantages.

As the stacked formwork 10 and reinforcement 20 do not contain concrete during transport, they are light and relatively easy to manoeuvre when compared to standard precast concrete panels. The combined weight of a formwork 10 and reinforcement 20 can vary widely from 1000 kg to 10,000 kg (10 tonnes) depending on the size of the structure, the reinforcement and the configuration of the braces. A standard 12*m* span formwork 10 and reinforcement 20 will weigh ~4200 kg, where an equivalent precast concrete panel weighs ~26000 kg. This weight saving simplifies the distribution and installation requirements, and the associated costs, as all the required moving machinery (side-loader container trucks, etc.) is more readily available for handling lighter loads.

Concrete for the module 1 is added in a single pour, creating one homogeneous slab and eliminating longitudinal joins across the length and/or the width of the module 1. This has major structural advantages and increases confidence in the module durability and lifespan. For example, it eliminates longitudinal joins, particularly undesirable 'dry joins' which occur when filling in the gaps between precast panels with wet concrete; and the single large mass of concrete can better resist braking inertia, which is particularly important for large freight trucks.

In some embodiments, for example having spans of more than 13.7 m, two pours of concrete may be used—the first pour covering the beams, then after the concrete reached a predetermined strength, the deck is poured. This advantage is more relevant to the structure 110, made of multiple modules 1, where the concrete is poured into all modules at the same time, creating a homogeneous slab (regardless of whether there are more than one concrete pour).

In this manner the module 1 construction maintains many of the benefits of precast construction with the additional advantages of off-site manufacturing, standardisation, quality control and time savings, while reducing the transportation and cost limitations inherent to the precast construction method. It also eliminates the possibility of fractural cracking of the concrete during transport, which is a serious risk for precast panels.

The module 1 use pre-certified designs, reducing the need for on-site engineers. Additionally, the reduction in on-site skills required makes it easier to source the required labour locally. This construction method is particularly attractive for remote areas, such as mines, where transporting precast slabs is not a viable or economical option, and there are limited skilled resources for in situ construction.

Figure 10:
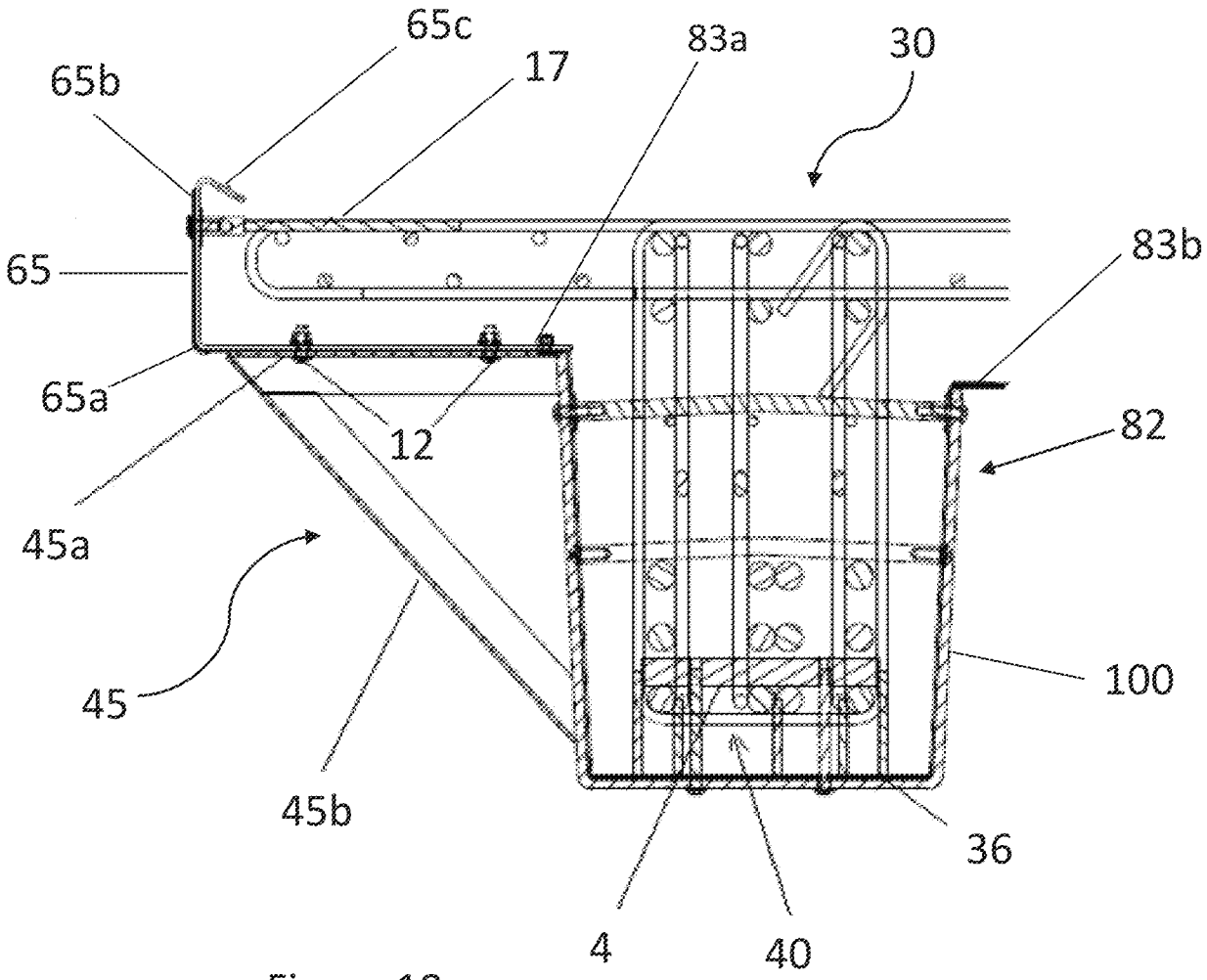
FIG. 10 is a cross-sectional view through an increased overhang module, illustrating a support wing disposed on an underside of the module.

A support wing 45 disposed on an underside of the module 1 is illustrated in FIGS. 10 and 11. In the embodiment illustrated in FIG. 10, the support wing 45 comprises an upper plate 45*a* and a lower plate 45*b*, the two plates being joined and converging to form an acute angle therebetween. The support wing 45 comprises at least two sides, formed from an upper plate 45*a* and a lower plate 45*b*. In some embodiments a third plate may be added to the support wing 45 to form a closed perimeter to the wing 45. Each of plates 45*a* and 45*b* are illustrated in FIGS. 11A and 11B to be angle-sections having an L-shaped cross section. A plurality of holes is provided along the upper plate 45*a* for receiving connectors, such as bolts 21, pins, bars and the like.

The support wing 45 is employed in combination with a formwork extension 65 to increase the overhang of at least one side of the module 1. This may provide advantages in facilitating an increase in the usable width of the module 1 without the expense of a subsequent module 1. In some embodiments a formwork extension 65 can be located on opposing sides of the module 1 in combination with support wings 45 on opposing sides of the module 1 to provide a symmetrical overhang on opposing sides of the module 1. FIG. 10 illustrates the support wing 45 and the formwork extension 65 on a first side of the module 1.

The formwork extension 65 is an L-shaped member comprising two arms 65*a* and 65*b*. The first arm 65*a* is positioned substantially horizontally to effectively extend the outer flange 83*a* of the trough segment 82 outwardly away from the formwork 10. The second arm 65*b* is positioned substantially vertically to accommodate the predetermined depth of upper reinforcement 30 to be incorporated into the module 1. The formwork extension 65 may further comprise a lip 65*c*. The lip 65*c* extends along the perimeter of the formwork extension and is angled inwardly and downwardly into the cavity 63 of the module 1. In this manner, the lip 65*c* assists in restraining the pourable substrate while curing. Furthermore, the lip 65*c* is obscured from view when the pourable substrate cures in the module 1, and does not protrude outwardly therefrom. Various additional forms of formwork extension 65 can be used, depending on the desired side profile to the module 1. In some embodiments the formwork extension can extend sufficiently above a top surface 25 of the module 1, to provide a railing or side barrier (not illustrated) to the edges of the module.

The upper plate 45*a* of the wing 45 is located adjacent to the outer flange 83*a* of the trough segment 82 such that the upper plate 45*a* is substantially parallel and contiguous with at least a portion of the first arm 65*a* of the formwork extension 65. The upper plate 45*a* and the first arm 65*a* can be adhered to one another via chemical bonding agents or alternatively can be welded, riveted, or bolted (as shown in FIG. 10) using securing bolts 21 or the like.

The lower plate 45*b* of the support wing 45 extends downwardly towards the base 36 of the trough segment 82 and forms a hypotenuse with the outer side wall 18 of the trough segment 82 and the first arm 65*a* of the formwork extension 65, thereby distributing load from the top surface 25 of the module 1 downwardly into the trough segments 82 and the internal reinforcement structure 20 therein.

The support wing 45 is contemplated to have a thickness of about 5 mm; however, this can be varied up or down depending on the extension dimensions and the load carrying requirements of the extended module 1. Each plate of the support wing 45 is about 50 mm in length; however, these plates can be reduced or extended to support the desired overhang to the module 1.

The support wing 45 is configured to not extend all the way to the base 36 of the trough segment 82 or to extend all the way to the second arm 65*b* of the formwork extensions 65. By stopping the support wing 45 short of the extremities of the module 1 by about 50 mm, the support wing does not affect the aesthetics of the module 1 or provide unnecessary snagging protrusions around the perimeter of the module 1.

In some embodiments the second arm 65*b* of the formwork extension 65 is configured to support an intermediate connector 17 therethrough to connect the formwork extension 65 to the upper reinforcement 30 of the reinforcement structure 20. A plurality of intermediate connectors 17 can be used around the upper reinforcement 30 and can be tightened to pre-tension the top surface 25 of the module 1 prior to the introduction of concrete or alternative pourable substrate into the cavity 63 of the module 1.

Figure 12:
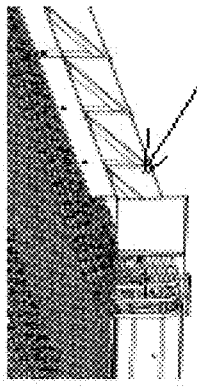
FIG. 12 is a perspective view of a formwork module constructed using a plurality of wing supports to increase the usable width thereof.
Figure 11C:
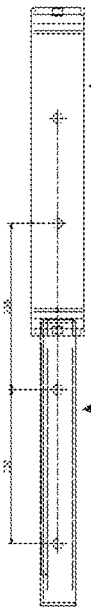
FIGS. 11A-11D illustrate the support wing in position adjacent the formwork brace in perspective, side, top and end views respectively.
Figure 11D:
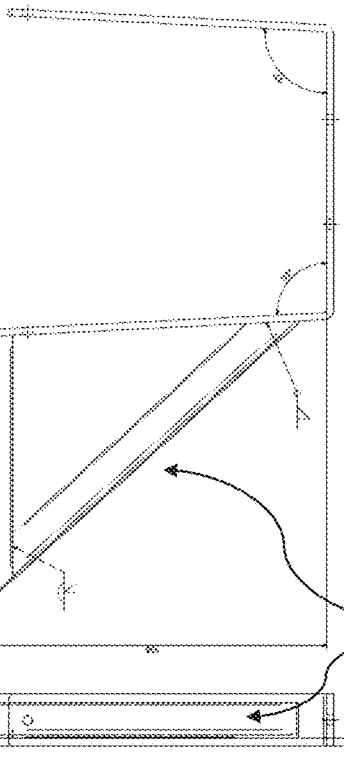
Figure 11B:
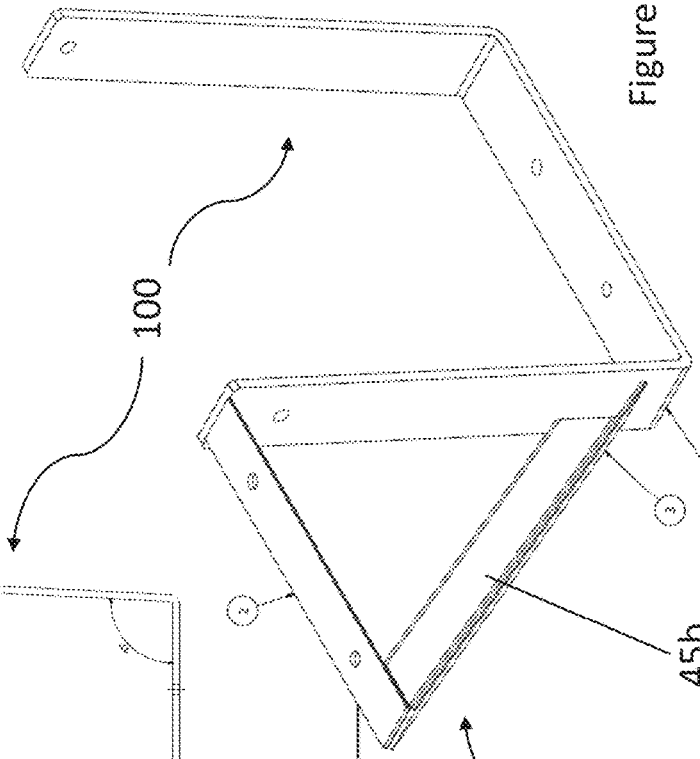
Figure 11A:
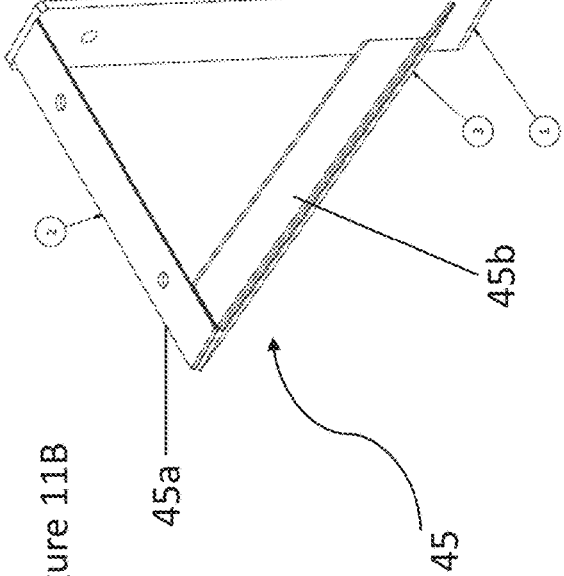

FIG. 12 illustrates a module 1 constructed using a plurality of braces 100 having support wings 45 extending along the trough segment 82. The braces 100 and attached support wings 45 are spaced approximately every metre along the trough segment 82 and every third brace 100 straddles a joint between two adjacent trough segments 82.

Figure 14:
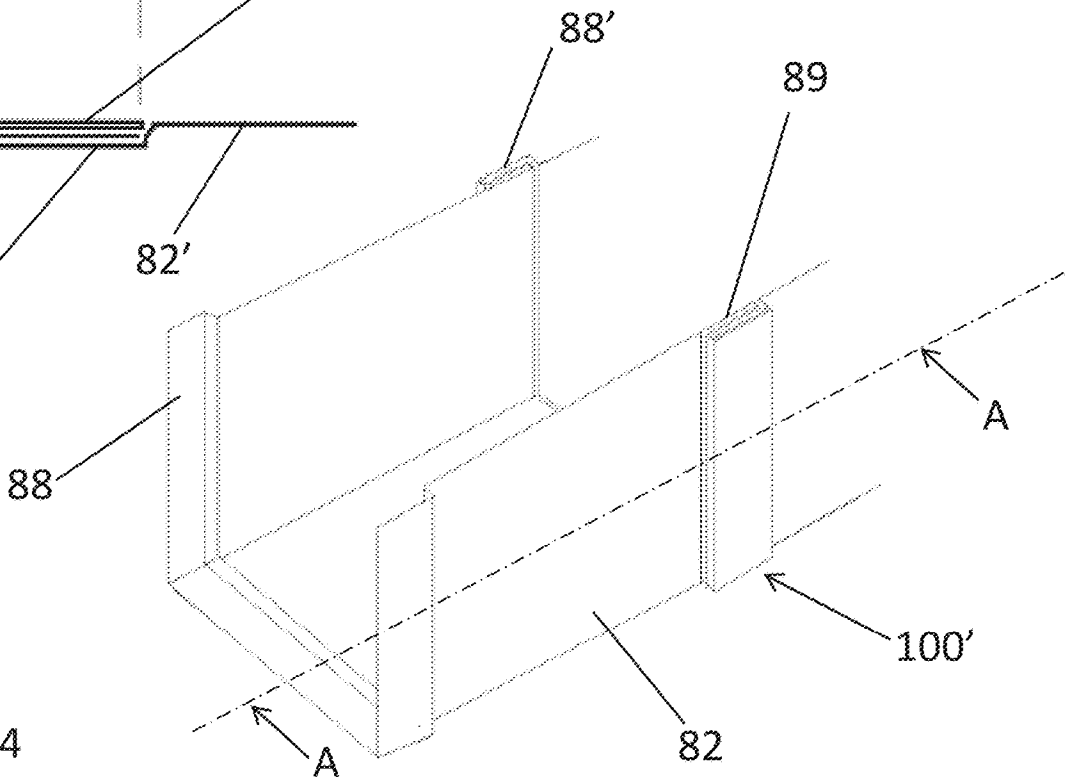
FIG. 14 is a perspective view of a formwork constructed from two trough segments, illustrating a brace formed between the overlapping trough segments.

In a second aspect of the invention, a formwork brace 100' is configured integrally by a pair of overlapping ends of two adjacent troughs 82, 82' as illustrated in FIG. 14. A first end of the segment 82 is expanded to have a greater diameter than the remainder of the trough 82. The expanded portion forms a flanged end 88 to the segment 82. The form of the flanged end 88 can be pressed, moulded, stamped or otherwise manufactured.

A second opposing end of the trough 82 has a crimped end 89, where the material of the trough 82 is folded over on itself to form a double material thickness at the second end of the trough 82. The crimped end 89 has a width of about 75 mm-100 mm.

When the two segments 82 are brought together, the flanged end 88' of one segment 82' receives the crimped end 89 of the adjacent segment 82. Three-ply of material is then overlapped, one-ply from the flanged end 88' and two-ply from the crimped end 89, forming an integrated brace 100' between the two, overlapping segment 82, 82' having a material thickness of three times the base material of the segments 82, 82'.

Also illustrated in FIG. 14, is an alternative embodiment of the flanged end 88', where the material of the trough segment is folded over to form a crimped end, before being pressed or moulded to form the flanged end 88'. In this manner, four material thicknesses of the segments 82, 82' can be overlapped to form the brace 100'.

Figure 15:
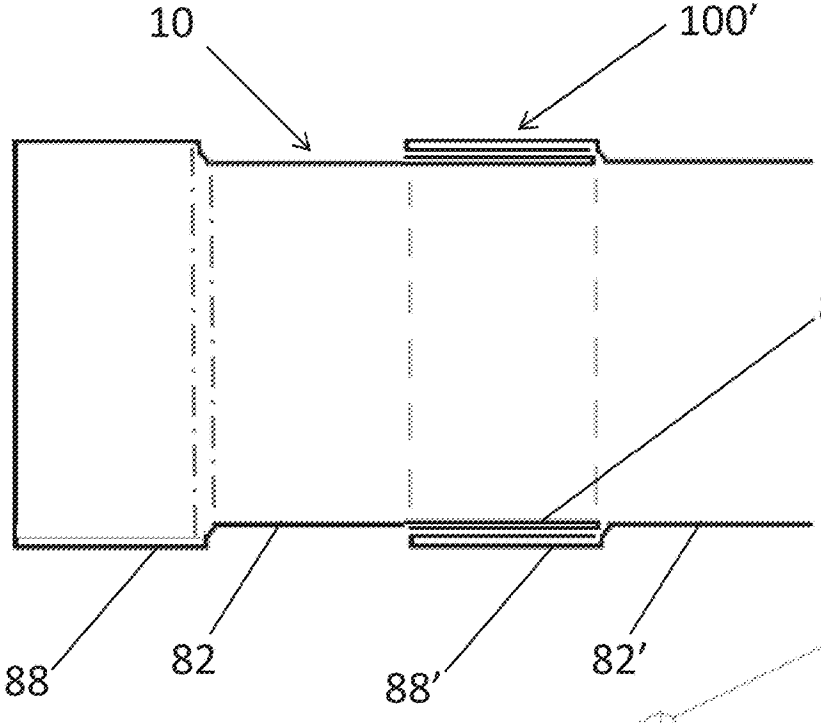
FIG. 15 is a cross section through line A-A of FIG. 14, illustrating the overlap portion between the trough segments in greater detail.

FIG. 15 is a cross section through line A-A of FIG. 14, illustrating the overlap portion between the trough segments in greater detail. The flanged end 88 is illustrated as having a single material ply contrasted to the two-ply of material at the crimped end 89. However, the adjacent segment 82' is illustrated in section to have a two-ply flanged end 88' to illustrate a four-ply overlap of material to form the brace 100'.

The person skilled in the art will appreciate that the size of module 1, span of the module 1 and function of the module 1 will dictate the strength required in the finished module 1. As such, the ability to increase the strength of the brace 100' by incorporating additional thicknesses of material will allow for more tailored, and localised reinforcement to the module 1. The tailoring of material only where needed, as opposed to increasing the gauge of the material throughout all the segments 82, 82', should provide overall mass savings and improved material utilisation for the finished module 1.

Each of the segments 82, 82' can be formed in 3-metre-long sections. Alternatively, each of the segments 82, 82' can be formed in 2 metres, or 1 metre sections, making them easier to form, easier to handle, easier to transport and removing manufacturing limitations from the size of the tooling required to form each section. This can open up new manufacturing opportunities and further modularise the production of each module 1.

Figure 16:
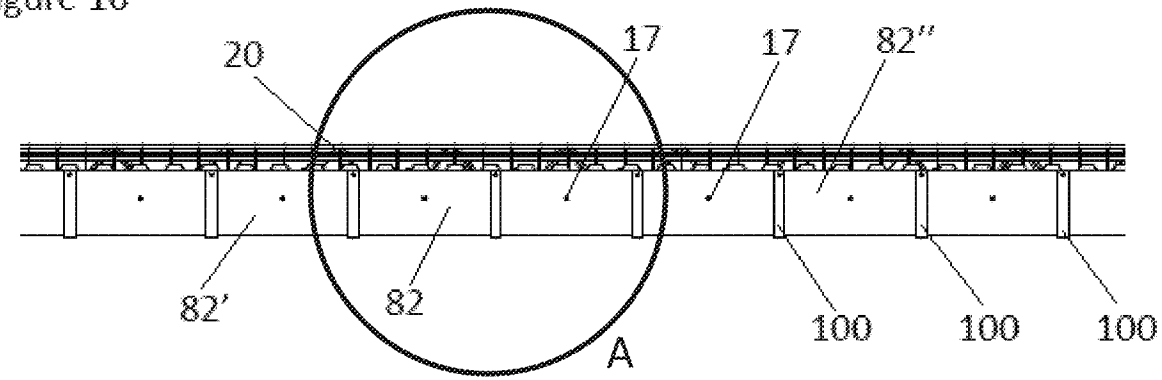
FIG. 16 is a side view of a formwork module illustrating a plurality of external formwork braces at spaced intervals along the formwork.

FIG. 16 is a side view of a formwork module 1 illustrating a plurality of external formwork braces 100, 100' at spaced intervals of 1 metre along the formwork 10. Every third brace 100, 100' overlaps a pair of adjacent trough segments 82, 82'. A further two braces 100, 100' are disposed in the centre of each segment 82, 82' which do not overlap adjacent segments 82, 82'.

Figure 16A:
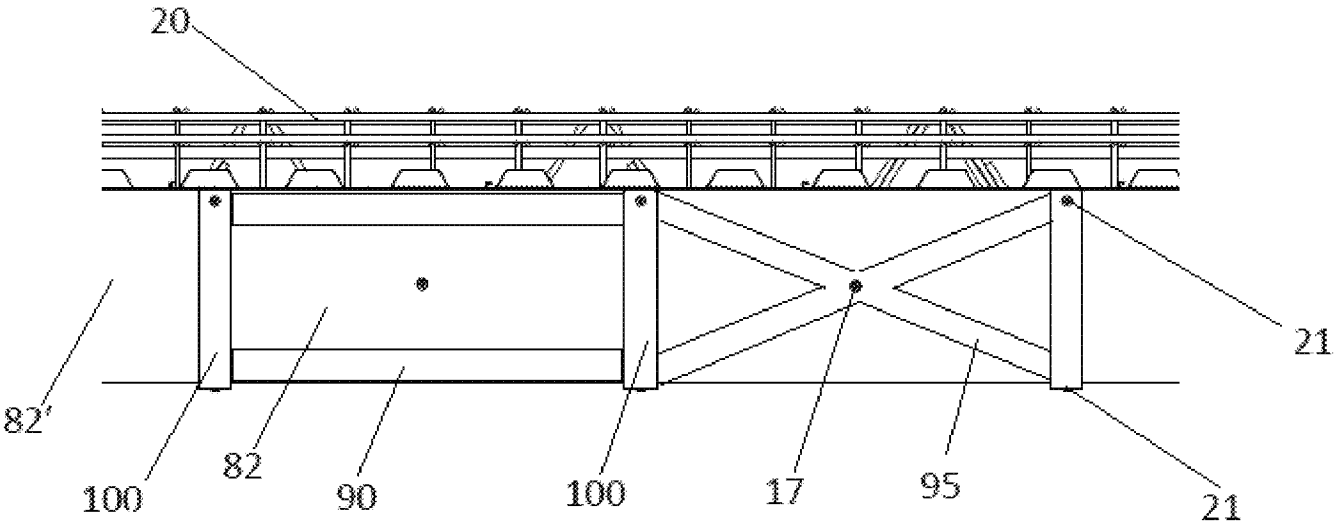
FIG. 16A is an enlarged view of circle A from FIG. 16, illustrating additional cross-bracing configurations that can be incorporated between the formwork braces on either the inside or the outside of the formwork.

FIG. 16A is an enlarged view of circle A from FIG. 16, illustrating additional cross-bracing configurations that can be incorporated between the formwork braces 100, 100' on either the inside or the outside of the formwork 10. It is contemplated that this cross-bracing can be utilised in combination with brace 100 or brace 100' and is not limited to a single embodiment of the formwork brace.

FIG. 16A illustrates a pair of linear cross-braces 90 that extend between two adjacent formwork braces 100, 100'. The linear cross-braces 90 can be mounted or bolted into the existing tie-bar mounts 70 and secured with the existing M12 securing bolts 21. The linear cross-braces 90 can be flat plate members, and are also contemplated to be formed as tensioned cables that can be adjustably tensioned between the formwork braces 100, 100.

Also illustrated in FIG. 16A is a pair of diagonal cross-braces 95 that extend between two adjacent formwork braces 100, 100'. The diagonal cross-braces 95 can be mounted or bolted into the existing tie-bar mounts 70 and also captured in the intermediate connectors 17 inter-disposed between the braces 100, and secured with the existing M12 securing bolts 21. The diagonal cross-braces 95 can be flat plate members, and are also contemplated to be formed as tensioned cables that can be adjustably tensioned between formwork braces 100, 100'.

It will be appreciated by persons skilled in the art that numerous variations and modifications may be made to the above-described embodiments, without departing from the scope of the following claims. The present embodiments are, therefore, to be considered in all respects as illustrative and not restrictive.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, a limited number of the exemplary methods and materials are described herein.

It is to be understood that, if any prior art publication is referred to herein, such reference does not constitute an admission that the publication forms a part of the common general knowledge in the art, in Australia or any other country.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

LEGEND

| Ref# | Description |
|---|---|
| 1 | Construction Module |
| 2 | Brace body |
| 3 | Central member |
| 4 | Anchor |
| 5 | Legs |
| 6 | Base of body |
| 7 | Arms of body |
| 7a | Open arm end |
| 8 | Apertures |
| 9 | Holes |
| 10 | Formwork Mbr |
| 11 | Tapped hole |
| 12 | Retaining Bolt |
| 13 | Bore |
| 14 | Seam |
| 16 | Module side wall |
| 17 | Intermediate connector |
| 18 | Trough outer wall |
| 19 | Trough inner wall |
| 20 | Reinforcement |
| 21 | Bolt |
| 25 | Top Surface |
| 30 | Upper Reinf |
| 34 | Line-wire |
| 35 | Cross-wire |
| 36 | Trough base |
| 37 | Ringtail thread |
| 40 | Lower Reinf |
| 41 | Frames |
| 42 | Truss |
| 43 | End truss |
| 44a | 1$^{st}$ Longit mbr |
| 44b | 2nd Longit mbr |
| 45 | Support Wing |
| 45a | Upper plate |
| 45b | Lower plate |
| 46 | Intermediate mbr |
| 54 | Ringtail bolt |

-continued

LEGEND

| Ref# | Description |
|---|---|
| 55 | Hook |
| 56 | Circular aperture |
| 57 | Mounting hole |
| 58 | Ringtail mount |
| 59 | Ringtail shank |
| 60 | Supplemental connector |
| 61 | Gap |
| 63 | Cavity |
| 65 | Formwork Extension |
| 70 | Cross-tie mounts |
| 71 | Central beam |
| 72a | Member + hook |
| 72b | Secondary mbr |
| 74 | Washer |
| 75 | Upper tie-bar |
| 76 | Ctrl brace beam |
| 78 | Ligature |
| 79 | End ligature |
| 80 | Elongate beam |
| 82 | Trough segment |
| 83 | Top flange |
| 83a | Outer flange |
| 83b | Inner flange |
| 84 | End cap |
| 85 | Mount flange |
| 86 | Stiffening plate |
| 87 | Gap |
| 88 | flanged end |
| 89 | Crimped end |
| 90 | Linear bracing |
| 95 | Diagonal-bracing |
| 100 | Brace |
| 110 | Structure |

What is claimed is:

1. A module for forming a reinforced concrete structure comprising (a) a formwork tray that defines a cavity for reinforcement and concrete, (b) an internal reinforcement structure disposed within the cavity, and (c) at least one formwork brace interconnecting the formwork tray and the reinforcement structure, the formwork brace comprising:

a body including a central portion and a pair of arms that extend away from opposing ends of the central portion, the body substantially conforming to and extending around an exterior of the formwork tray;

a first connector that extends across an interior of the formwork tray and engages with each of the pair of arms to thereby tension the body around the formwork tray; and an anchor disposed internally of the formwork tray coupling together the body and the internal reinforcement structure through the formwork tray wherein the module is configured such that, when concrete fills and cures within the cavity of the formwork tray to at least partially cover the internal reinforcement structure, the formwork tray, the internal reinforcement structure and the formwork brace are integrally combined.

2. The module defined in claim 1, wherein the first connector comprises a central beam and a pair of mounts, with the central beam extending across the interior of the formwork tray, and with each mount being configured to engage with a respective arm of the body.

3. The module defined in claim 1, comprising a plurality of the formwork braces at spaced intervals along the length of the module.

4. The module defined in claim 3, wherein the formwork tray comprises a plurality of sections along the length of the module.

5. The module defined in claim 4, wherein at least one of the plurality of formwork braces is located at an intersection between successive sections along the length of the module.

6. The module as defined in claim 4, wherein the at least one formwork brace located at an intersection between successive sections overlaps a portion of each of the successive sections in substantially equal amounts.

7. The module of claim 1, wherein the anchor supports the internal reinforcement structure at a predetermined distance from a base of the formwork tray.

8. The module of claim 7, wherein the anchor comprises a pair of legs mounted to opposing ends of a cross-bar that extends across the cavity, the legs extending towards the base of the formwork tray and configured to position the formwork tray relative to the internal reinforcement structure.

9. The module of claim 1, further comprising at least one spacer that locates the internal reinforcement structure within the cavity prior to the introduction of concrete.

10. The module of claim 9, wherein the spacer extends from a respective end portion of the formwork brace inwardly of the formwork tray and couples the internal reinforcement structure to the formwork brace.

11. A formwork brace for interconnecting (a) a formwork tray that defines a cavity for reinforcement and concrete and (b) an internal reinforcement structure adapted to sit within the cavity, comprising:

a body including a central portion and a pair of integrally formed arms that extend away from opposing ends of the central portion, the body configured to substantially conform to and extend around an exterior of the formwork tray;

a first connector configured to extend across an interior of the formwork tray and to engage with each of the pair of arms to thereby tension the body around the tray; and an anchor configured to interleave with the internal reinforcement structure within the formwork tray and to engage with the body from an exterior of the formwork tray to couple the body to the formwork tray, wherein the formwork brace is configured such that, when concrete fills and cures within the cavity of the formwork tray to at least partially cover the internal reinforcement structure, the formwork tray, the internal reinforcement structure and the formwork brace are integrally combined.

12. The formwork brace of claim 11, wherein the first connector comprises a central beam and a pair of mounts, with the central beam extending across the interior of the formwork tray and with each mount being configured to engage with an arm of the formwork brace.

13. The formwork brace of claim 11, wherein the body is configured to be a U-shape.

14. The formwork brace of claim 12, wherein the mounts of the first connector are configured to adjustably tension the first connector across the body.

15. The formwork brace of claim 11, further comprising at least one spacer that extends inwardly from a respective arm of the body configured to locate the internal reinforcement structure within the cavity prior to the introduction of concrete.

16. The formwork brace of claim 15, wherein the spacer is configured to directly engage with the internal reinforcement structure.

17. The formwork brace of claim 11, wherein the anchor is dimensioned to support the internal reinforcement structure at a predetermined distance from a base of the formwork tray.

18. The formwork brace of claim 17, wherein the anchor is configured to receive a retaining bolt that extends through the base of the formwork tray from the exterior of the formwork tray.

19. The formwork brace of claim 18, wherein the anchor further comprises a pair of legs mounted to opposing ends of the cross-bar, the pair of legs extending towards the base of the formwork tray and configured to position the formwork tray relative to the internal reinforcement structure.

20. A method of constructing a formwork tray that defines a cavity for reinforcement and a settable substrate, comprising the steps of:

positioning a plurality of formwork sections end-to-end such that an end portion of a first formwork section abuts an end portion of a second formwork section;

locating a formwork brace to cradle overlapping ends of the first and second formwork sections, the formwork brace comprising a body including a central portion and a pair of arms that extend away from opposing ends of the central portion, the body substantially conforming to and extending around an exterior of the formwork sections;

inserting a reinforcement structure into the cavity; and engaging a first connector to extend between and engage with each of the pair of arms of the formwork brace through the first and second formwork sections to thereby hold the first and second formwork sections in tension, with the first connector extending across an interior of the formwork sections such that the formwork brace will integrally combine with the formwork tray and internal reinforcement structure when the settable substrate is poured into the cavity and cures.

* * * * *